US007963593B2

(12) United States Patent
Mitchell

(10) Patent No.: US 7,963,593 B2
(45) Date of Patent: Jun. 21, 2011

(54) ORGANIZER ATTACHABLE TO A CHAIR AND TASK UTILITY SYSTEM AND PROCESS OF PROVIDING SAME

(76) Inventor: Chad Mitchell, San Antonio, TX (US)

( * ) Notice: Subject to any disclaimer, the term of this patent is extended or adjusted under 35 U.S.C. 154(b) by 493 days.

(21) Appl. No.: 11/542,440

(22) Filed: Oct. 3, 2006

(65) Prior Publication Data

US 2008/0079292 A1 Apr. 3, 2008

(51) Int. Cl.
*A47C 31/00* (2006.01)

(52) U.S. Cl. ..... 297/172; 297/170; 297/188.2; 297/217.3

(58) Field of Classification Search ..... 297/170, 297/172, 188.2, 217.3, 217.6; 108/50.02; 312/223.6
See application file for complete search history.

(56) References Cited

U.S. PATENT DOCUMENTS

| | | | | | |
|---|---|---|---|---|---|
| 289,384 | A | | 12/1883 | Byrkit | |
| 366,525 | A | | 7/1887 | Taliaferro | |
| 4,094,256 | A | * | 6/1978 | Holper et al. | 108/50.02 |
| 4,163,867 | A | * | 8/1979 | Breidenbach | 174/481 |
| 4,255,610 | A | | 3/1981 | Textoris | |
| 4,323,291 | A | * | 4/1982 | Ball | 312/194 |
| 4,561,619 | A | | 12/1985 | Robillard et al. | |
| 4,567,835 | A | | 2/1986 | Reese et al. | |
| 4,645,167 | A | * | 2/1987 | Hardwick | 248/520 |
| 4,762,072 | A | * | 8/1988 | Boundy et al. | 108/50.02 |
| 4,838,175 | A | * | 6/1989 | Hauville | 108/25 |
| 4,852,500 | A | * | 8/1989 | Ryburg et al. | 108/105 |
| 4,880,270 | A | * | 11/1989 | Cooper | 297/188.21 |
| 5,121,698 | A | * | 6/1992 | Kelley | 108/143 |
| 5,158,074 | A | * | 10/1992 | Grellas | 601/24 |
| 5,490,710 | A | | 2/1996 | Dearing et al. | |
| 5,600,098 | A | | 2/1997 | Kazaks | |
| 5,653,499 | A | | 8/1997 | Goodall | |
| 5,775,521 | A | | 7/1998 | Tisbo | |
| 5,893,607 | A | | 4/1999 | Trimnell | |
| 5,909,934 | A | * | 6/1999 | McGraw | 312/223.3 |
| 5,911,178 | A | | 6/1999 | Alexander | |
| 6,254,206 | B1 | * | 7/2001 | Petrick et al. | 312/223.6 |

(Continued)

OTHER PUBLICATIONS

Mobile Office Environments, Inc.—Rolladesk Web Site/Page: www.mobiledesk.com/Rolladesk.htm.

(Continued)

*Primary Examiner* — Peter R. Brown
(74) *Attorney, Agent, or Firm* — Robert M. Hunter

(57) ABSTRACT

An organizer and utility apparatus that can be attached to a chair comprises a generally horizontal elongate support which can be in the form of a tube or channeled block. The elongate support has one or more holder attachments that can be joined in a permanent fashion or mutually engaged and disengaged and located according to user preference. The elongate support can be supported directly on a desk, or with an attachable generally vertical support, supported above a floor or desk; Or with such attachable vertical support, engaged to a chair that has a chair attachment mechanism. If the organizer is either freestanding or attached to a chair, it can be converted into a work station by the use of an engageable plane-attachment accessory. If free standing, the vertical support is attached to a stand base. An embodiment of the apparatus has a wire conduit that permits electrical and electronics wire protection and management. In addition to organizing traditional items associated with desk work, it incorporates the possible organization of items such as computer monitors, lamps, electronic devices, and relatively smaller organizers or specific holders.

18 Claims, 18 Drawing Sheets

U.S. PATENT DOCUMENTS

| | | | | |
|---|---|---|---|---|
| 6,644,748 | B2 * | 11/2003 | Tholkes et al. | 297/423.12 |
| 6,903,266 | B1 | 6/2005 | Luciere | |
| 6,916,065 | B2 * | 7/2005 | Park | 297/217.1 |
| 6,953,222 | B2 * | 10/2005 | Larrick et al. | 297/172 |

OTHER PUBLICATIONS

Mobile Office Environments, Inc.—Field Desk Web Site/Page: www.mobiledesk.com/FieldDesk.htm.

* cited by examiner

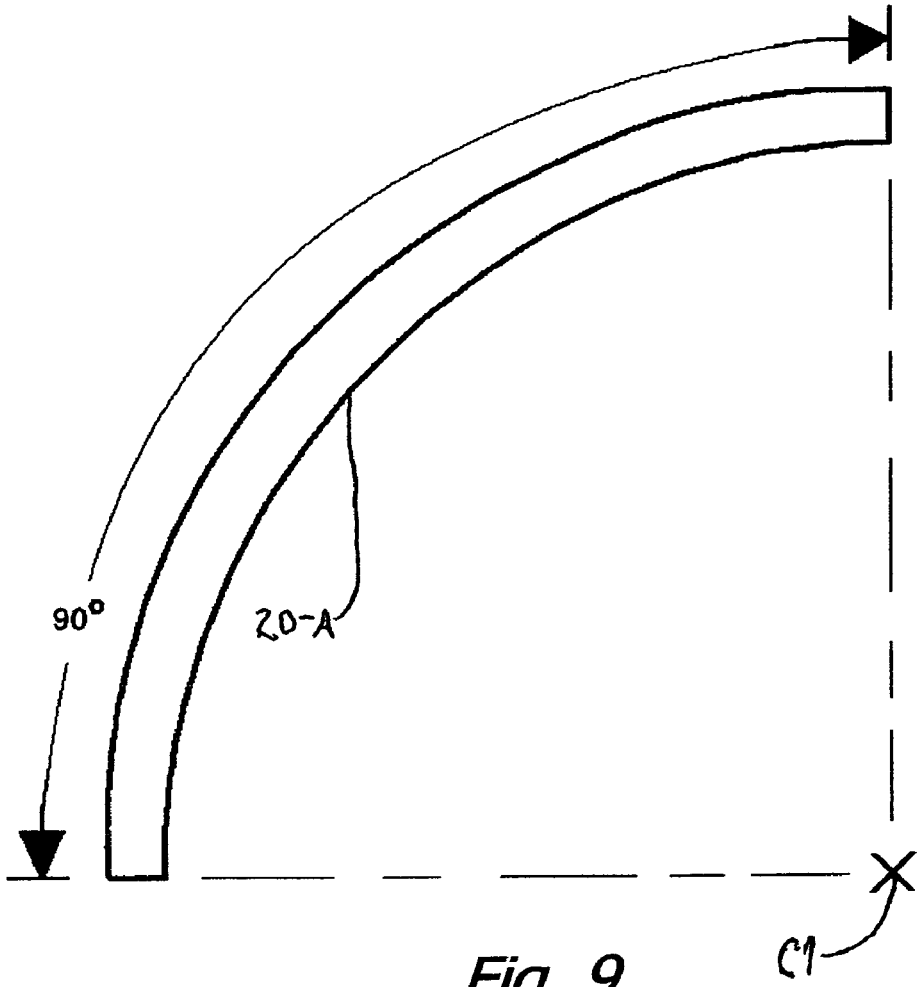
Fig. 9
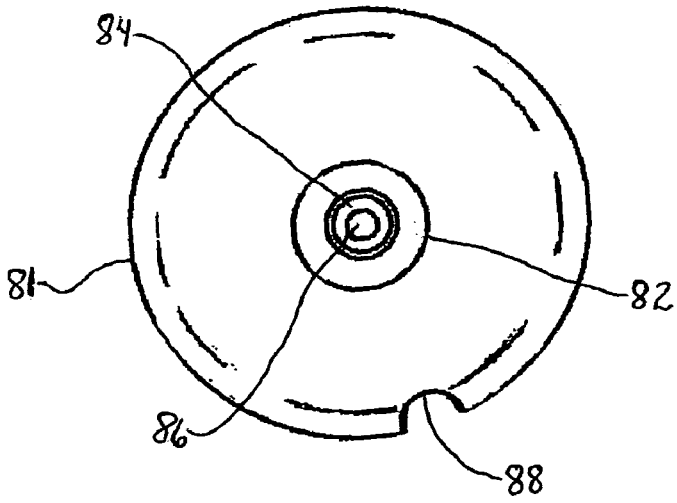
Fig. 10-A

Fig. 10-B

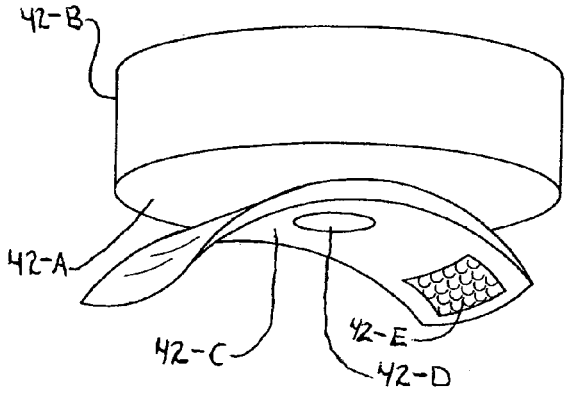
Fig. 12-A
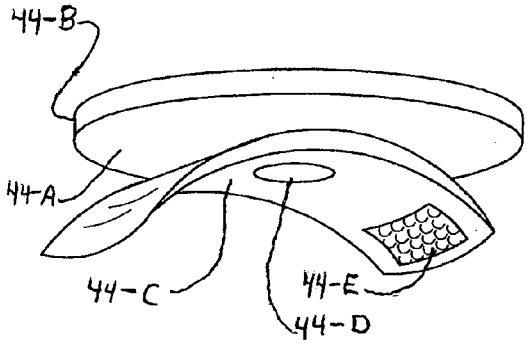
Fig. 12-B
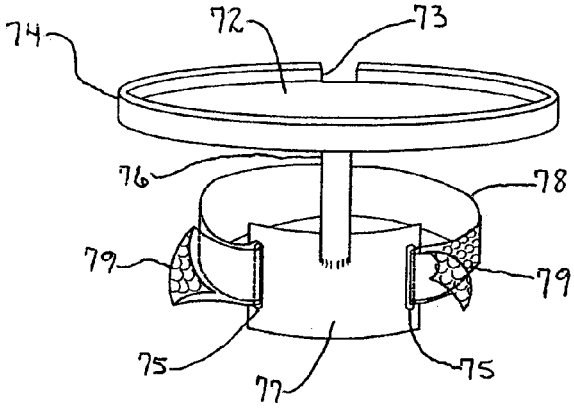
Fig. 12-C
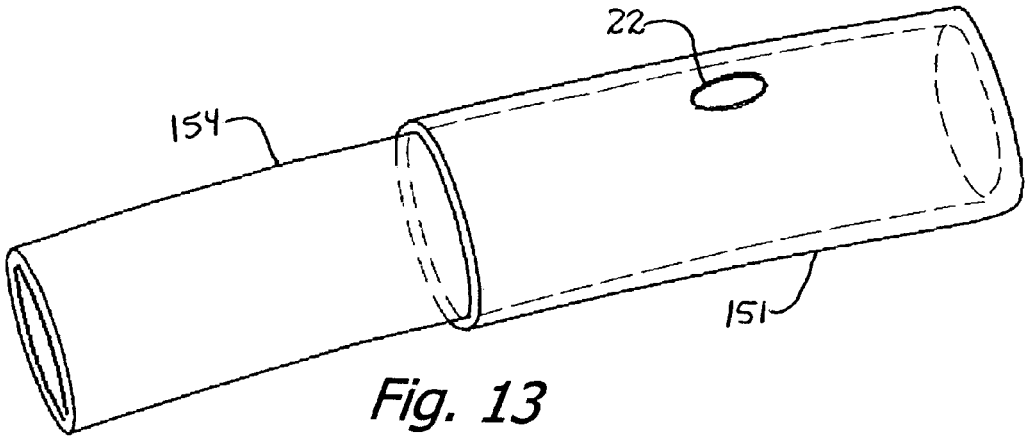
Fig. 13

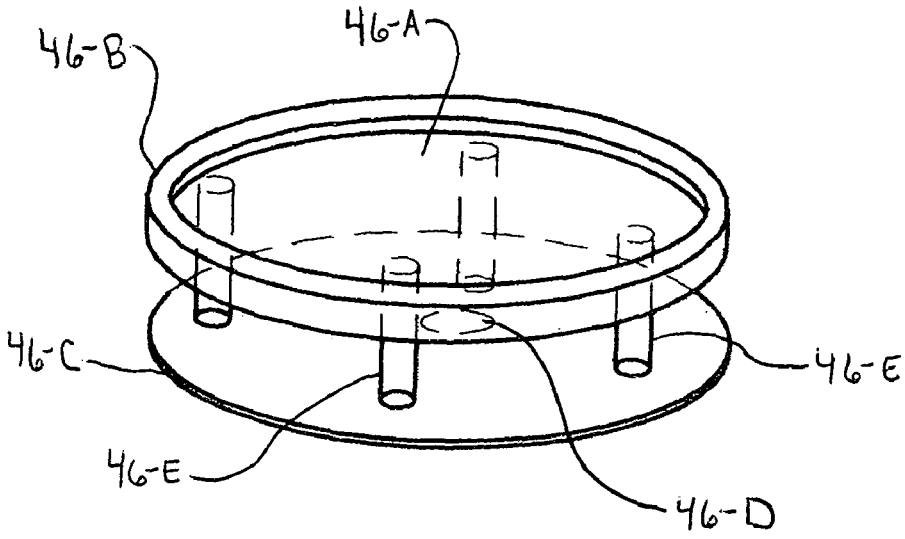
Fig. 14
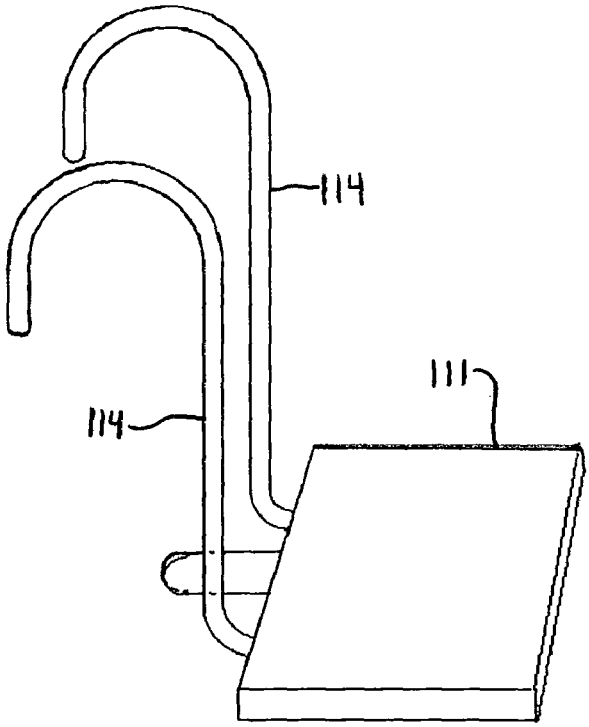
Fig. 15-A

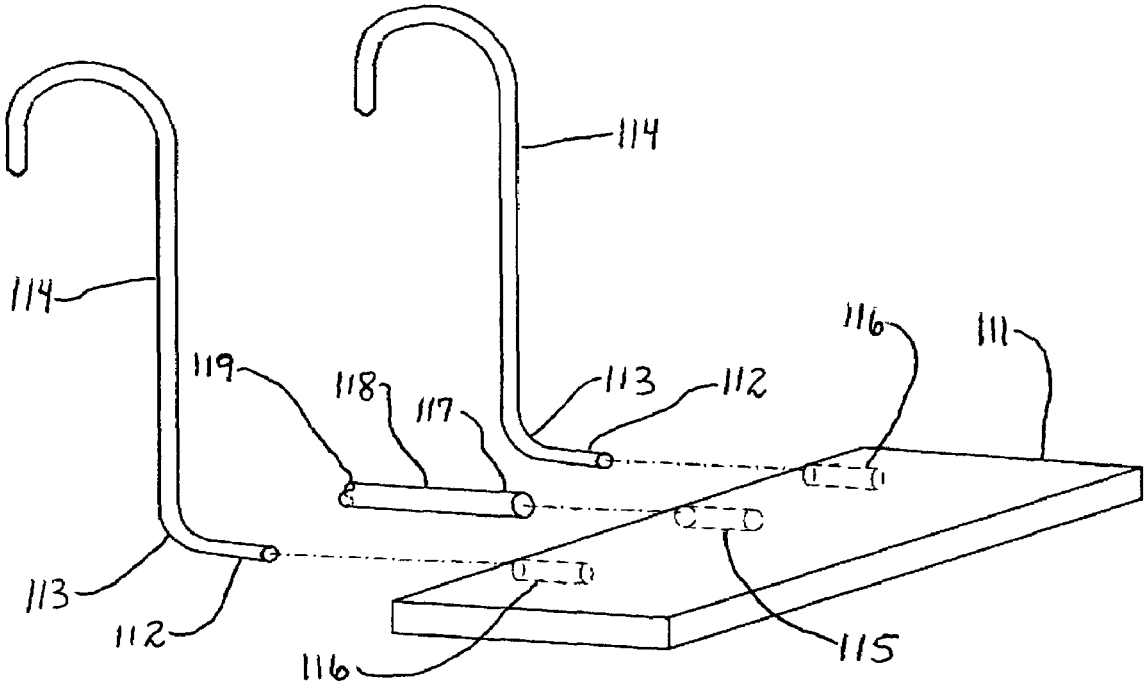
Fig. 15-B
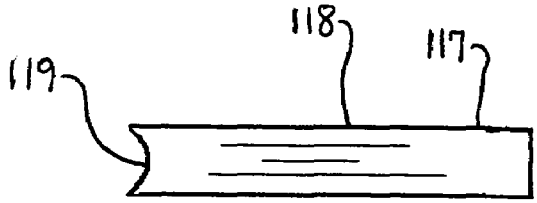
Fig. 15-C

ORGANIZER ATTACHABLE TO A CHAIR AND TASK UTILITY SYSTEM AND PROCESS OF PROVIDING SAME

FEDERALLY SPONSORED RESEARCH

Not Applicable

SEQUENCE LISTING OR PROGRAM

Not Applicable

BACKGROUND OF THE INVENTION

Copyright Notice

.COPYRGT.2006 Chad Mitchell. A portion of the disclosure of this patent document (including the drawings) is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This invention relates generally to office organizers, office related work stations and chair attached task supports. More specifically, the present invention relates to an elongate support with holder attachments, and which various embodiments can be mobile, removable, or permanently stationed depending upon the users needs for organization and/or project tasks.

DISCUSSION OF THE FIELD AND RELATED ART

Terminology of "desk items": Various items and implements normally associated with working at a desk and organized on traditional desktop organizers include pens, pencils, transparent tape, paper clips, notepads, adhesive-backed notes, rulers, push pins, rubber bands, scissors, staplers, and the like. Though a concept of the present invention challenges the notion that such items normally associated with working at a desk should necessarily or in all cases be organized on or with such, for facilitated understanding of the invention, such items and implements are hereinafter referred to as "desk items" even when a desk is not being used in an example of usage, except in instances which may require that the specific item be mentioned.

Terminology of "portable electronic devices": Various items normally associated as personal mobile electronic devices such as digital cameras, MP3 players, PDA's (portable digital assistants), electronic organizers, cell or mobile phones, I-PODS, electronic dictionaries, calculators, and the like are hereinafter referred to as "portable electronic devices" except in instances which may require that the specific item be mentioned.

Terminology of "electronics wires": Wires that extend from portable electronic devices, computer monitors, computer peripherals, or the like to be in communication with computers or other electronics are hereinafter referred to as "electronics wires."

Terminology of "auxiliary devices": Other items and implements which are helpful in doing office related work but are not normally associated with being organized on office organizers, such as clocks, lamps, computer monitors, and relatively smaller or more specific desktop organizers or holders are hereinafter referred to as "auxiliary devices" except in instances which may require that the specific item be mentioned.

Terminology of "station": A desk or work area in which a person performs office work and/or office type related tasks, chores, or projects is hereinafter referred to as a "station."

Offices, cubical layouts, home offices, and the like environments are becoming more complicated with issues such as multiple projects, multiple stations, and multiple users of a single station. Each user of a station most likely has a unique preference concerning the organizational layout of the station, the manner in which they work at the station, and the manner in which they move from station to station.

At times, a temporary station may be needed such as in a case whereby an office is expanding or additional desks may be on order, but have not yet been received. Or when a visitor is present such as a job applicant. And in such cases it may not be appropriate or adequate to use an ordinary table for use as a station, because such table has no assisted organization and/or no means for a platform and/or no means for impediment of items which may blow off of, or roll off of such table. However, if there was a means to convert such table into a more adequate station, it may be appropriate and/or adequate as a station.

If there is an organizational attitude of a single worker that works at multiple stations, the worker can benefit from a mobile organizer by having the arranged accessories and the like move in the already arranged order to the other station(s). An office task chair or the like can be an essential focus for organization and multiple project working because it is already mobile, can naturally move from station to station, and is usually in close proximity with the in-use station. Or, may even be a station by itself or part of a station.

In some cases, it may be needed that desk items not be organized on a desk or joined to such desk by any means, thus giving a person more area to work and not feel crowded. For example, a worker may have large poster boards, blue prints, or plans for example that may need to hang off of a portion of a desk, and an organizer or the like that is joined in a permanent fashion will only get in the way of such work. Thus, an organizer that can be placed nearby instead of on or attached to a desk or cubical wall, can allow a better work environment in such situations. Even in such times that work can be performed with large items such as blue prints butting up against and covering an organizer, such a situation interferes with access to items on such organizer. Other times, a person may desire to have an organizer engaged to their desk, but always have the accessible option of moving an organizer off and away from their desk in case of such a project that requires more space to work on.

In modern times, many kinds of portable electronic devices are designed to transfer data to and/or from a computer CPU (central processing unit) either in the form of what is well known as a desktop computer or what is well known as a notebook or laptop computer. When a person returns to the office or station, the person may desire convenient placement and connection of the subject kind of devices to a wire plug in a desired location. Or, convenient placement and connection to a wire plug from one computer to another, such as allowing a portable notebook computer to be in communication with a desktop computer from an organized location.

In some offices, cubical layouts, home offices, and the like environments, two or more persons may need to share at least some desk items and/or portable electronic devices even as they work at different stations. Moreover, a shared organizational method for portable electronic device communication is needed in some cases. For example, in an environment such as that whereby multiple persons had digital cameras to do field work. And upon returning to their base office to upload digital pictures to a communal CPU, if such persons could have an organized and convenient connection method to an associated electronic wire plug to allow communication to such CPU, it would increase productivity by saving time.

Other persons who do office related work, but not necessarily or always in an office or the like, such as security guards, inventory clerks, construction site foremen, field investigators, ticket porters, and the like can benefit from having a mobile and/or portable organizer. They can also benefit from having a mobile and/or portable station.

Additionally, a system that can address all of the above issues can save time and money and manage unforeseen exigencies that may arise in an office or the like environment, or when performing office related tasks. For example, if an organizer is kept in a supply closet, and if such organizer could convert into a complete station, either permanently or temporarily, a situation such as a new office worker needing a station could be resolved without sending a courier to buy a new desk.

The following art defines the present state of this field:

Tisbo, U.S. Pat. No. 5,775,521 describes an office organizer with a wire chase assembly for receiving and organizing wires running along the desk. However, while the Tisbo application describes a very limited form of wire management, it does not teach convenient wire plug connection of items that are routinely taken away from the office, brought back, and need ready convenient connection from an organized location. This is evident as the wire chase addition is on the bottom of the described slat wall sections of the Tisbo device. And in the Tisbo application it is related that the objective for the wire chase addition is for concealing and organizing cords associated with desk top devices. Also, in the detailed description of the Tisbo application, it is related that the use for the wire chase serves as a conduit for wires running between equipment to wall plugs. Thus, from the Tisbo application, it is apparent to those skilled in the art that Tisbo did not invent portable electronic device convenient connection organization. Also, the Tisbo organizer is limited to being attached to the back or side of a desk or directly to a wall, while some office environments may not provide a wall in close enough proximity to a desk. And if attached to a wall that is not up against the desk in use, it further demonstrates the wire hiding and wire management inadequacies thereof. Also, in the background of the invention section of the Tisbo application, it is related that a desk becomes the primary focus for any type of organization. Furthermore, the Tisbo organizer can not be attached as taught to some types of desks.

U.S. Pat. No. 6,903,266, U.S. Pat. No. 5,600,098, and U.S. Pat. No. 4,255,610 are much like the Tisbo wire chase in that such patents teach organization of wires categorically by means of bundling, straightening, or neatly aligning such wires along a desk, but not organized placement of devices with management of wires by proper divergence of such.

Alexander, U.S. Pat. No. 5,911,178 describes a spatial work-in-progress organizer for display and organization of documents. However, Alexander's art is designed for display and organization of documents or the like. And is consistently freestanding and always supported by a floor. Additionally, Alexander's art does not teach wire management capabilities which is important for modern office and the like environments whereof various portable electronic devices, auxiliary devices, computers and associated peripherals should have organized placement and convenient connection of associated wire plugs. Furthermore, Alexander does not teach auxiliary device support such as for computer monitors and lamps. For these reasons among other reasons, most users of either Alexander's invention or the present invention would know that the present invention is of a different art and spirit than that of Alexander's, even when the present invention is demonstrated in a freestanding arrangement.

Ryburg, et al., U.S. Pat. No. 4,852,500 describes an integrated computer implement work area. However, the Ryburg work area is permanently part of the desk work area. Such kind of devices are deficient for multiple project organization and multiple project working because a separate work area or separate work areas may be needed or desirable for separation of projects. And moving the Ryburg embodiment may intrude upon the layout of the office setting across different departmental functions. Furthermore, the Ryburg work area is bulky which takes up an unnecessary amount of space and makes mobility more difficult, and it is not able to pass through some room doors if any, or into office cubicles.

Trimnell, U.S. Pat. No. 5,893,607 describes a chair attached computer keyboard holder. However, the Trimnell device does not provide any kind of support for a computer monitor. The Trimnell device does not teach accessory organization and does not offer an organizer-only arrangement. Additionally, the Trimnell device is limited to only being attachable to a chair. Furthermore, such device does not provide a barricade to help prevent items from being accidentally knocked off away from the user.

Dearing, et al., U.S. Pat. No. 5,490,710 describes a swing arm chair. However, the Dearing device does not teach user controlled organization, and is limited to chairs which have armrests. Furthermore, such kind of devices obstruct the functionality of at least one of the armrests.

The present invention can address the issues and problems noted above and others which will become obvious after reading the following descriptions and inspecting the drawings. Furthermore, a new method of providing organizing and tasking capabilities to a user will also become obvious to those skilled in the art of supply, stock control, or sales displays.

ADVANTAGES

The present invention provides an apparatus and methods of use of such apparatus not taught by the prior art. Accordingly, the present invention may have one or more of the following advantages:

(a) It permits portable electronic devices and computer peripherals to be in communication with a computer or other electronic devices from an organized location with manipulated divergence of associated wires.

(b) It permits auxiliary devices such as computer monitors, lamps, and relatively smaller and/or more specific organizers or holders to be communally organized systematically with desk items and/or portable electronic devices.

(c) It provides an organizing apparatus capable of converting into a station to accommodate user needs.

(d) It provides an organizing apparatus capable of attachment to an office chair.

(e) It provides an organizing apparatus capable of freestanding apart from a desk, on a desk, or through a desk to accommodate various user needs.

(f) It provides an organizing apparatus capable of facilitated mobility by various means.

(g) It can transform plane surfaced structures such as tables and serving counters into more practical stations for office related work when a generally more adequate station such as a desk is not available.

(h) It provides a common implement to ramify accommodation of organizing capabilities isolated, tasking capabilities isolated, or both organizing capabilities and tasking capabilities combined.

(i) It provides compact and dismemberable parts for stock shelving and storage.

Aspects and other advantages of the present invention will become apparent from the following descriptions, taken in connection with the accompanying drawings, wherein, by way of illustration and example, an embodiment of the present invention is disclosed.

BRIEF SUMMARY OF THE INVENTION

In accordance with a preferred embodiment of the invention, there is disclosed an organizer and utility apparatus that comprises an elongate support structure. The elongate support structure is held in a horizontal attitude from a supporting structure that is contingent with associated user needs or desires. In one embodiment, said supporting structure can be a desk or similar structure that has a generally horizontal plane. In such embodiment, the elongate support structure has a conduit means for electrical wires and/or electronics wires. The elongate support structure has one or more holder attachments that can be removably engaged or joined in a more permanent fashion and positioned along the length of the elongate support structure according to user preference.

In a method and further embodiment, a generally vertical support props the elongate support structure above a portion of a desk or the like structure's horizontal plane at a portion of such structure having a horizontal plane according to user preference. The vertical support can be directly supported by a horizontal surface such as a floor or shelf if also supported at its sides such as in a cutout made in a desk. The vertical support in its preferred embodiment, includes a wire conduit means to allow continuation of wire management.

In a further embodiment, the elongate support structure is propped above a stand base with the vertical support to effect a freestanding arrangement. In such embodiment, the vertical support is supported by a stand base. In such freestanding arrangement, a user can effect yet a further embodiment of a more complete station by attaching a plane attachment which can be used in a desk-like manner, or as another organizing means such as using the plane attachment as a bookshelf or in a table-like manner.

In another embodiment, the vertical support is used to prop the elongate support structure from a chair attachment mechanism. In the preferred embodiment of such, the chair attachment mechanism is joined to the chair base, whereby the according apparatus can be positioned behind the chair back allowing the user access to sit down and stand up from the chair seat without such embodiment getting in the way of doing such. Then, the user can turn the chair backing, positioning the apparatus for yet a further embodiment for use as a more complete station by engaging the plane attachment.

Other accessories include an extension attachment and an auxiliary stand. The extension attachment provides length for at least one additional holding means if the elongated support structure does not provide enough area for certain users needs or desires. The auxiliary stand in the preferred embodiment is a holding means that can be placed on another holding means. The auxiliary stand can be made of varying heights to allow a user to select the desired height positioning of certain auxiliary devices such as lamps and computer monitors. The auxiliary stand also provides a means to prevent wire nipping for items organized on the holder attachments, in which, in the preferred embodiment, certain holder attachments have a hole for use as a wire passage.

The invention therefore can provide new methods of providing such. For example, an embodiment of the invention provides organizing usage components, task usage components, or components that can be used for either organizing usage or task usage. An embodiment of the invention also provides at least one common support structure that can be used effectively in a freestanding arrangement, desktop arrangement, or chair conjunction arrangement. Whereby, providing greater control of warehouse storage, backroom storage, stock handling, shelving and/or display in stores. Also thus, providing suppliers and retailers with a variety of selling options.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 9 is a top plan view of a customizable elongate support defining the preferred curvature;

FIG. 10-B is an exploded perspective view of such free standing organizer mode of which hypothetically the user customized and three holder attachments were selected to be attached by the user;

FIG. 12-A is a perspective view of the underside of a bowl-like holder;

FIG. 12-B is a perspective view of the underside of a plate-like holder;

FIG. 12-C is an illustration of the vertical support holder-attachment accessory;

FIG. 13 is a perspective view of an extension attachment accessory;

FIG. 14 is a perspective view of an auxiliary stand which is a means for wire nip prevention and height positioning of organized items;

FIG. 15-A is a perspective view of the desk-like attachment accessory;

FIG. 15-B is an exploded perspective view of the desk-like attachment accessory;

FIG. 15-C is an illustration of the brace-rod that is joined with the desk-like attachment accessory for a better view thereof apart from the above exploded view;

Figure 1:
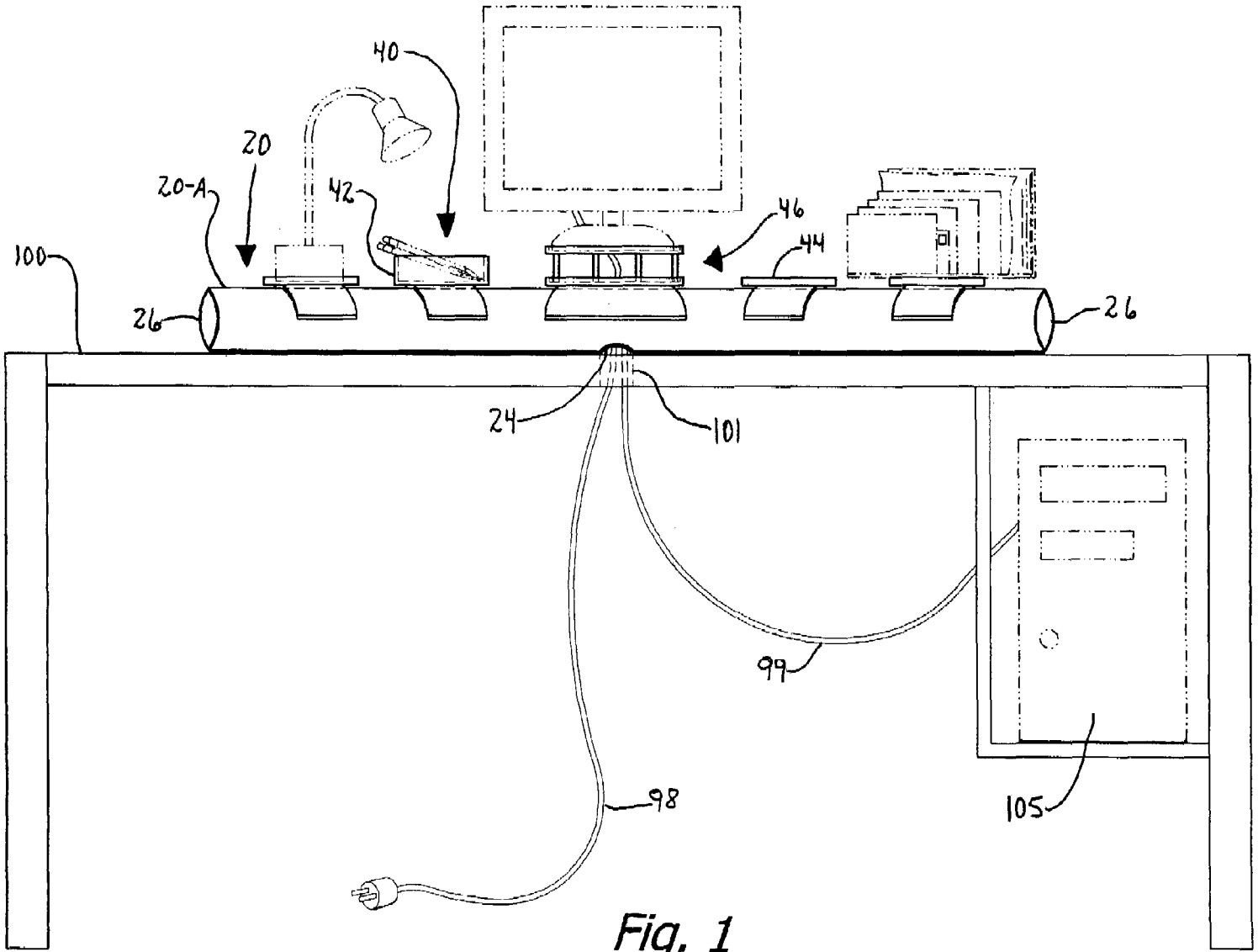
FIG. 1 is a front elevational view of one of the preferred embodiments in use supported directly on a desk.

The terminology and phraseology which will be used in the following description is for purpose of description and illustration, and is used to refer to all technical equivalents which operate in a similar manner to accomplish a similar purpose. For example, the words "downwardly", "upwardly", "leftwardly" and "rightwardly" will refer to directions in the drawings to which reference is made. Thus, examples are clearly provided but are not limiting.

DETAILED DESCRIPTION

Detailed descriptions of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

In accordance with the present invention, FIG. 1 illustrates a preferred embodiment in a possible use. However, while demonstrating platform support and the ability for a computer monitor to be organized communally with other items, a computer keyboard is missing for a better view of the invention. The invention includes an elongate-support 20 which is preferably a cylindrical-tube 20-A made of a rigid, structural, light material such as plastic or aluminum, and in the particular illustration of FIG. 1, the elongate-support 20 is supported directly on the generally horizontal plane surface of a desk 100. However, such plane surface can also belong to a table, bench, serving counter, shelf, or the like of sufficient size. The elongate-support 20 is engaged to such plane surface by gravity in the particular illustration of FIG. 1.

Figure 2:
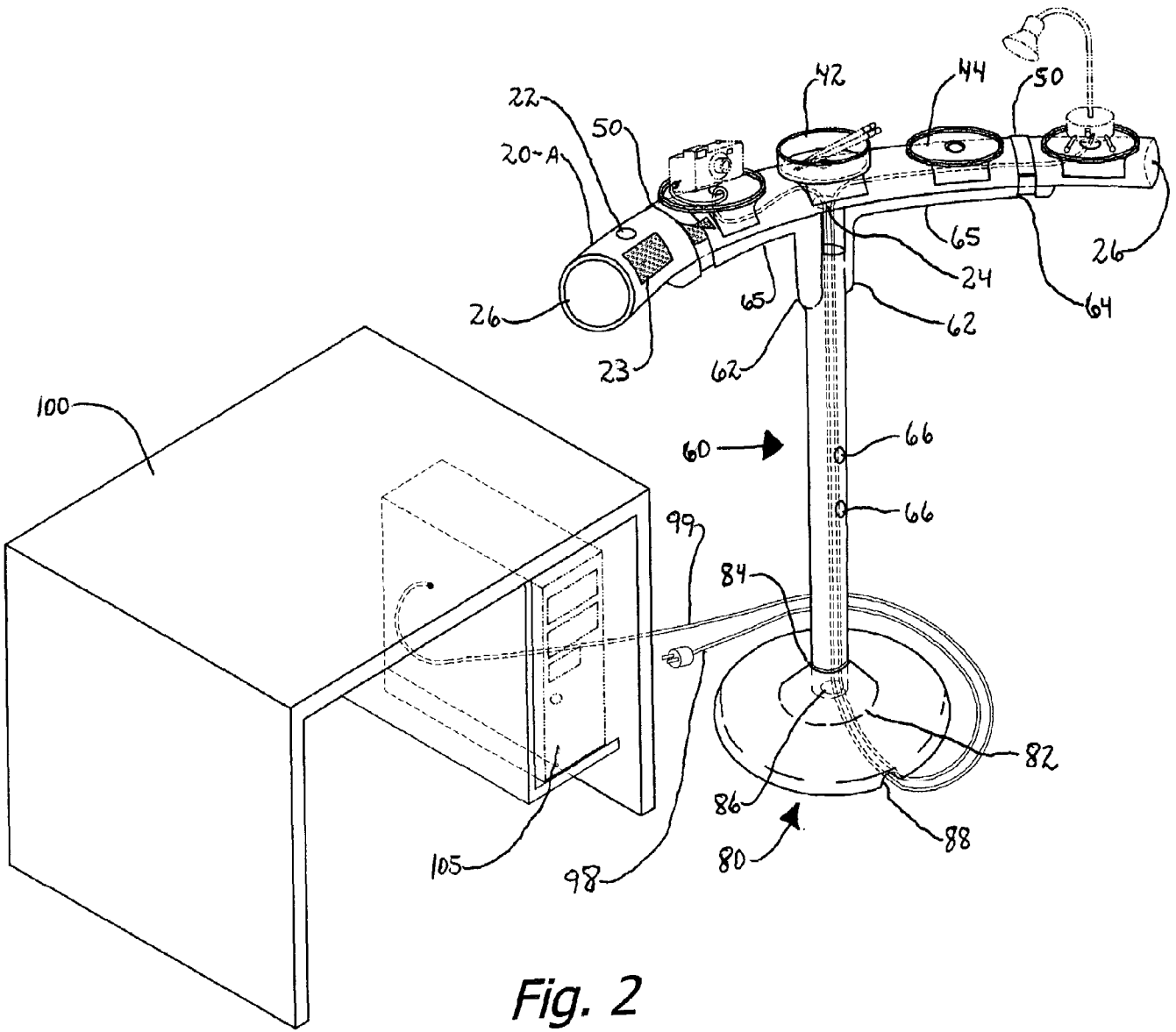
FIG. 2 is a perspective view thereof engaged to a substantially vertical support of which is further engaged to a stand-base accessory to effect a freestanding organizer arrangement and defining wire passage enablement.

Referring particularly to FIG. 1, FIG. 2, and FIG. 9, the cylindrical-tube 20-A is preferably of a bent or curved embodiment. In the particular embodiment illustrated, such curvature defines a generally circular-arc configuration. The circular-arc configuration as shown in FIG. 9 is preferably formed with substantially symmetrical circular curvature. And the open ends 26 of the illustrated embodiment as shown in FIG. 9 are preferably cut aligning substantially radially straight to an imaginary centerpoint C1 of an imaginary circle (not shown) with the cylindrical-tube 20-A substituting a portion of the imaginary circle. The portion of the imaginary circle that the cylindrical-tube 20-A substitutes for reference purpose, is the longitudinal length of the cylindrical-tube 20-A. In the illustrated embodiment, the overall circular extent of the cylindrical-tube 20-A preferably is such as to define a generally quarter-circle configuration when viewed in a plan view, and in the illustrated embodiment the cylindrical-tube 20-A extends through an angle which will preferably be in the range of from about 70.degree to about 110.degree. As shown in FIG. 1, as the apparatus is in a plane engaging arrangement, if the elongate-support 20 is a cylindrical-tube 20-A, the circular-arc configuration allows the cylindrical-tube 20-A to be directly supported on a desk or the like structure without any other support mechanisms.

Figure 10:
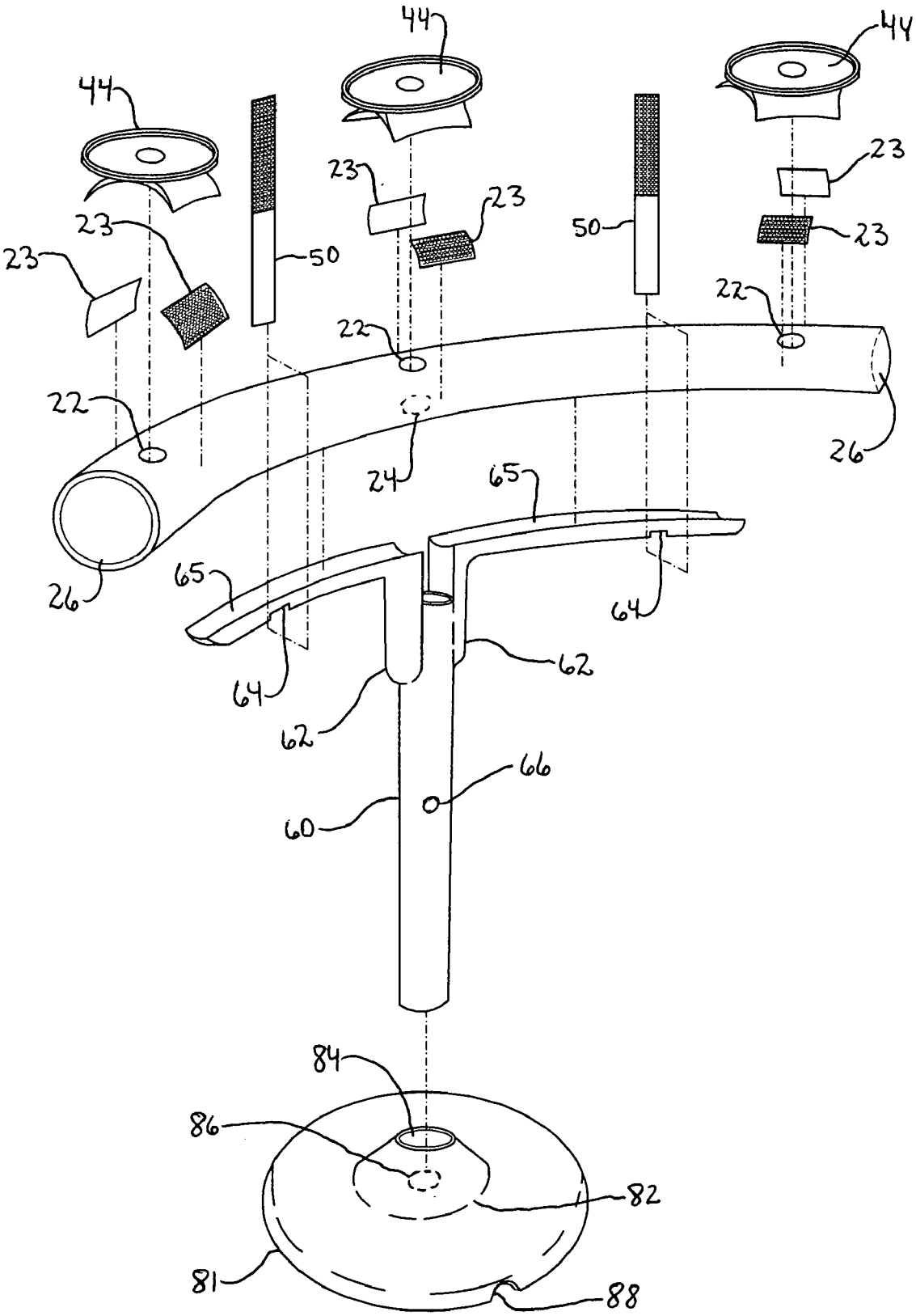
FIG. 10-A is a top plan view of the stand-base accessory.

Referring particularly to FIG. 2 and FIG. 10-B, the cylindrical-tube 20-A preferably provides at least one aperture, opening or passage more specifically defined as a port-hole 22 for reference purpose, which is preferably annular shaped and of sufficient diameter for at least one electrical wire 98 or electronics wire 99 and associated plug to pass through such port-hole 22. The port-hole/s 22, if provided should preferably be substantially symmetrically spaced apart on generally the apex of the cylindrical-tube 20-A. However, the port-holes 22 do not need to be symmetrically spaced apart or even provided at all. Thus, allowing the user to customize the desired positioning and quantity of the port-holes 22 by means such as a punch or by drilling the port-holes 22 at a desired location or desired locations if any port-holes 22 are desired at all by the user. As another alternative, the port-hole/s 22 quantity and placement could also be partially customizable. For example, a single port-hole 22 could be premade by a manufacturer such as making a port-hole 22 on the central apex of the cylindrical-tube 20-A, or two port-holes 22 on each end portion thereof. Thus, the user could add additional port-holes 22 if needed or desired.

Preferably, a pair of fastening tapes 23 such as the kind of tapes made with the well known hook and loop type fastener material, VELCRO are placed adjacently to and with one fastening tape 23 on both sides of each of the port-holes 22. The fastening tapes 23 are so positioned to engage to the corresponding fastening tapes on the mounts of the holding means 40, discussed later. The fastening tapes 23 on the cylindrical-tube 20-A can be custom located by the user along with the port-holes 22 and the fastening tapes 23 will be positioned such that when the holding means 40 are engaged to the cylindrical-tube 20-A, the holes (if any) in the holding means 40 will align with the port-hole 22 to make a passage for at least one electrical wire 98 or electronics wire 99 and associated plug types. The holding means 40 is further discussed later.

The cylindrical-tube 20-A preferably further provides at least one slightly different aperture, opening or passage than such described and referred to as a port-hole 22. Such different passage is more specifically defined for reference purpose as a via-passage 24 to allow electrical wires 98 and electronics wires 99 and the associated plugs to pass through to the direction that such wires are going to or from. The via-passage 24 is preferably located on the central underside of the cylindrical-tube 20-A. However, the via-passage 24 is not necessarily essential to the embodiment in the basic functionality thereof. For example, modern technology allows remote radio signals to be transmitted through the cylindrical-tube 20-A. Thus, if the cylindrical-tube 20-A was not in use with electrical wire 98 passage, but only the port-holes 22 for electronics wires 99 were in use, and if a radio transmitting device were encased inside the cylindrical-tube 20-A, a via-passage 24 would not be necessary. The via-passage 24 also would not be necessary if using one or both of the open ends 26. The via-passage 24 provides more precise routing of at least one wire. However, the via-passage 24 is preferably made of a large enough diameter to provide a communal wire passage for a plurality of wires.

Figure 8:
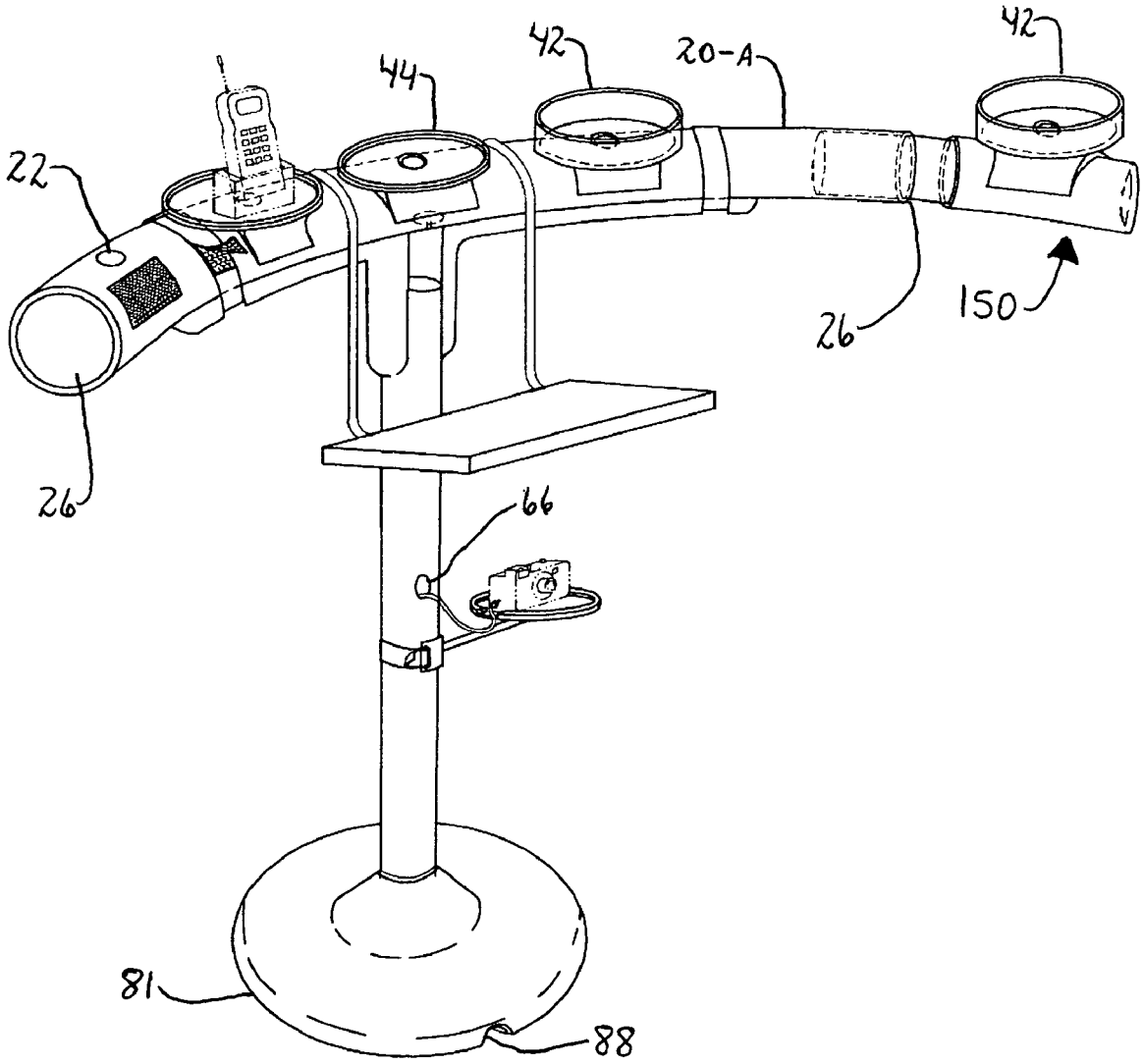
FIG. 8 is a perspective view thereof defining a means for extension and such accessory attachment.

The cylindrical-tube 20-A preferably has open ends 26 which can also perform with generally the same functionality as the via-passage 24 or the port-holes 22 as an optional method. However, using the open ends 26 as the only wire passage means does not as adequately hide and protect such wires in most instances. Though there are instances in which the open ends 26 offer a comparable wire passage means which will be discussed later. The open ends 26 can also be used as a means for extension and/or accessory engagement as shown in FIG. 8.

The invention also includes a variety of attachable holding means 40 for desk items and/or portable electronic devices and/or auxiliary devices. The attachable holding means may take a variety of forms and the numeral 40 will be used to refer to each of the embodiments described here. Referring particularly to FIGS. 1-3 and FIG. 12-A, the holding means 40 is preferably a bowl-like holder 42 made of a rigid, structural, light material such as aluminum or plastic formed of a disc shaped disc-plane 42-A having an annular flange 42-B extending perpendicularly upwardly at its outer end. And also having a yoke-like mount 42-C that cusps from the central bottom of the disc-plane 42-A. The mount 42-C forms a semicylinder and is designed to be supported on a section of the upper side of the cylindrical-tube of the portion of the cylindrical-tube 20-A that the mount 42-C is supported on in a mate-like or couple-like manner. Thus, in the illustrated embodiment such as shown in FIG. 1 and FIG. 12-A, the mount 42-C has similar diameter and congruent curvilinear shape as a portion of the upper side outer surface of the cylindrical-tube 20-A of the portion of the cylindrical-tube 20-A that the mount 42-C is supported on.

Referring particularly to FIG. 1 and FIG. 10-B, the mount 42-C preferably is supported on a portion of the cylindrical-tube 20-A that is generally about half of the horizontal width of the disc-plane 42-A, but such support area is preferably not horizontally wider than the disc-plane 42-A. Preferably, on the underside of the mount 42-C is a pair of corresponding fastening tapes 42-E which engage with fastening tapes 23 on the cylindrical-tube 20-A if not joined to the cylindrical-tube 20-A in a permanent manner. The pair of corresponding fastening tapes 42-E are placed one on each side near the bottom end of the mount 42-C.

The bowl-like holder 42 preferably further provides a hole 42-D of the same diameter as the port-holes 22 on the cylindrical-tube 20-A. Such hole 42-D preferably annular in shape is preferably located in the center of the disc-plane 42-A, and extending all the way through the mount 42-C. Alternatively, such hole 42-D would not be provided, and if needed or desired by the user, the user could drill such hole 42-D. The holding means 40 without such hole, would prevent smaller items such as paper clips from falling into such hole.

An alternative plate-like holder 44 has the same specifications as the bowl-like holder 42 with the exception that the annular flange 44-B is of a relatively shorter length upwardly on the plate-like holder 44 as opposed to the annular flange 42-B having a relatively longer length upwardly on the bowl-like holder 42. This, and the comparison is best seen by viewing both FIG. 12-A and FIG. 12-B respectively. Thus, in order to prevent possible confusion to a person rereading this description, the plate-like holder 44 is not further explained beyond naming the parts to such, as such further description would be unnecessarily redundant. Referring now to FIG. 12-B, the illustrated plate-like holder 44 also has a disc-plane 44-A, an annular flange 44-B, a mount 44-C, a hole 44-D (or alternatively no such hole), and a pair of corresponding fastening tapes 44-E if using such fastening tapes 23 on the cylindrical-tube 20.

Though the particular illustrated attachable holding means 40 may appear to be in the nature of a receptacle, it is not limited to a receptacle embodiment or usage. For example, if the annular flange 44-B was completely cut off from the plate-like holder 44, such holding means 40 could still be used, for example, for items such as often used reference books such as dictionaries or thesauruses. Also, as shown in FIG. 1, a specific letter/paper organizer is actually placed on and extending outside of the annular flange 44-B. Thus, the attachable holding means 40 is not limited to a receptacle embodiment. However, a flange or other retaining means can help items from falling off or out of such attachable holding means 40, particularly if mobilizing the apparatus.

The holding means 40 is preferably mutually engageable and disengageable to the cylindrical-tube 20-A by the use of the units of fastening tapes from the fastening tapes 23 on the cylindrical-tube 20-A and the holding means 40 corresponding fastening tapes. Alternatively, the holding means 40 can be joined in a more rigid manner, particularly after the user has the desired set-up for the users style of organization. The holding means 40 can be rigidly joined by the use of an adhesive such as polyurethane glue (not shown) or by rigid fasteners such as screws (not shown) by first drilling at least one pilot hole (not shown) in the mount 42-C of the bowl-like holder or the mount 44-C of the plate-like holder. If using as adhesive to rigidly join the holding means 40 to the elongate support 20, such adhesive should not block any port-holes 22. Those skilled in the art would know how to join the mount of the holding means 40 to the elongate support 20 with rigid fasteners such as screws. Most users also would know how to join the mount of the holding means 40 to the elongate support 20 with rigid fasteners such as screws, particularly if instructions were provided that explains such joinery with a sold unit. If using rigid fasteners such as screws to join the mounts to the elongate support 20, preferably a pilot hole would be drilled through the mount 42-C of the bowl-like holder or the mount 44-C of the plate-like holder on each side centrally in the area that the fastening tapes would be if using such fastening tapes instead of rigid fasteners such as screws. If using rigid fasteners such as screws to join the holding means 40 to the elongate support, such fasteners should not pierce through the elongate support 20 so deep that such fastening means would substantially interfere with any wires that may be inside of the elongate support 20.

Both the bowl-like holder 42 and the plate-like holder 44 can be made of varying sizes to accommodate various desk items, portable electronic devices, and/or auxiliary devices. The bowl-like holder 42 offers slight advantages and disadvantages comparatively to the plate-like holder 44. The bowl-like holder 42 better secures items from falling off or out of such holding means, particularly if mobilizing such organizer. While the plate-like holder 44 can provide easier access to some items such as paper clips or erasers.

The invention further includes a means for wire nip prevention accessory that can be an auxiliary-stand 46 as shown in FIG. 1. Though, wire nip prevention is not always necessary such as in a case that a wire may be nipped, but the weight of the device nipping the wire is not sufficient to cause considerable damage or impairment of such wires. Or, such auxiliary device may have its own lifted means that allows wires to pass beneath its own base without nipping its own such wires. Or, such device placed on the holding means 40 has a small enough base that will allow it to be placed on such holding means 40 without covering the passage means or hole of such holding means 40. The auxiliary-stand 46, if necessary, allows electrical wires 98 and electronics wires 99 and associated plug types to pass between the base of auxiliary devices such as flat panel monitors or lamps and the disc-plane 42-A of the bowl-like holder or the disc-plane 44-A of the plate-like holder without nipping such wires. The auxiliary-stand 46 can also be used as a means to support such auxiliary devices such as computer monitors and lamps at an accommodating height for the user. Thus, such auxiliary-stands can be made of varying vertical heights whereby each unique user can choose an auxiliary-stand 46 or auxiliary-stands 46 more suited to each unique users needs or desires.

Referring to FIG. 1 and FIG. 14, the auxiliary-stand 46 is made of a rigid, structural, light material such as aluminum or plastic and has a base 46-C that is disc shaped providing an annular hole 46-D in the center thereof of generally the same diameter as the port-holes 22 of the cylindrical-tube 20-A. Also provided off of the top of the base 46-C is at least one stanchion 46-E, and in the preferred embodiment, four evenly spaced apart stanchions 46-E are provided and extend perpendicularly upwardly at a relatively outermost portion on top of the base 46-C. Yet distal enough from the outer edge of the base 46-C so electrical wires 98 and electronics wires 99 can pass between the annular flange 42-B of the bowl-like holder 42 or the annular flange 44-B of the plate-like holder 44 and such stanchions 46-E if necessary. The stanchions 46-E provide support for an upper-disc-plane 46-A and are preferably also integral to the upper-disc-plane 46-A. The upper-disc-plane 46-A also further provides a flange 46-B of annular shape extending perpendicularly upwardly at its outer end of a relatively short length upwardly such as the length upwardly of the annular flange 44-B of the plate-like holder 44. The base 46-C is of similar diameter of the inside of the annular flange 42-B of the bowl-like holder 42 or the inside of the annular flange 44-B of the plate-like holder 44 The base 46-C engageably rests inside of the annular flange 42-B of the bowl-like holder 42 or the annular flange 44-B of the plate-like holder 44 if engaged.

Referring to FIGS. 2-8 and FIG. 10-B, the invention also includes a prop or vertical support 60 made of a rigid, structural, light material such as aluminum or plastic. The vertical support 60 can also be used as a means for propping the elongate-support 20 above a further supporting structure. The vertical support 60 is preferably formed of a cylinder with open ends. Though the vertical support 60 can be made of various cross section, the roundness of the cylinder on the outer surface contributes to it being able to pivotally engage to items such as a stand-base 80 (discussed later). Though the vertical support 60 being able to pivot is not necessary, it is an extra feature of the invention.

Figure 6:
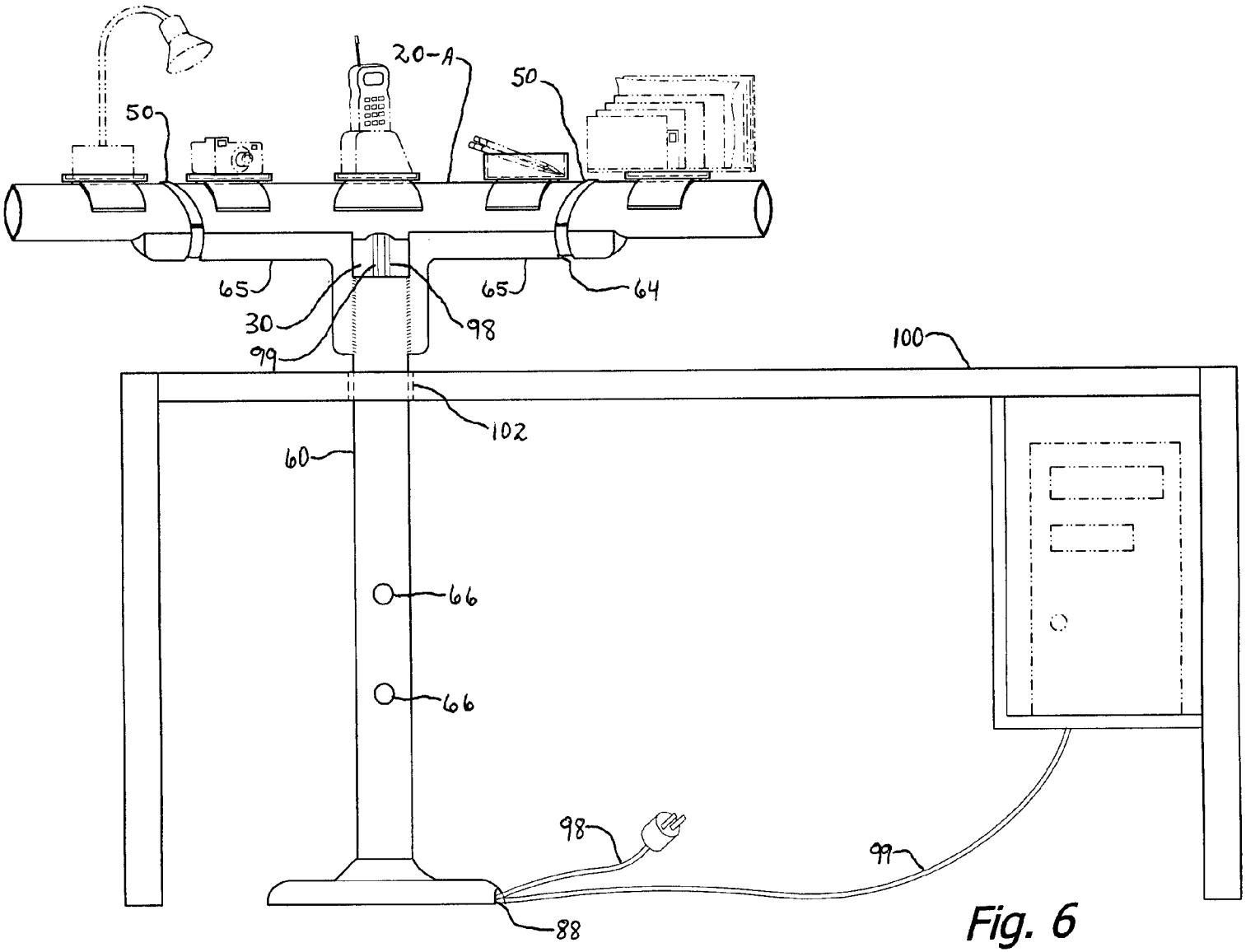
FIG. 6 is a front elevational view of one of the preferred embodiments in use in a through-desk method for elevated desktop organizing.
Figure 20A:
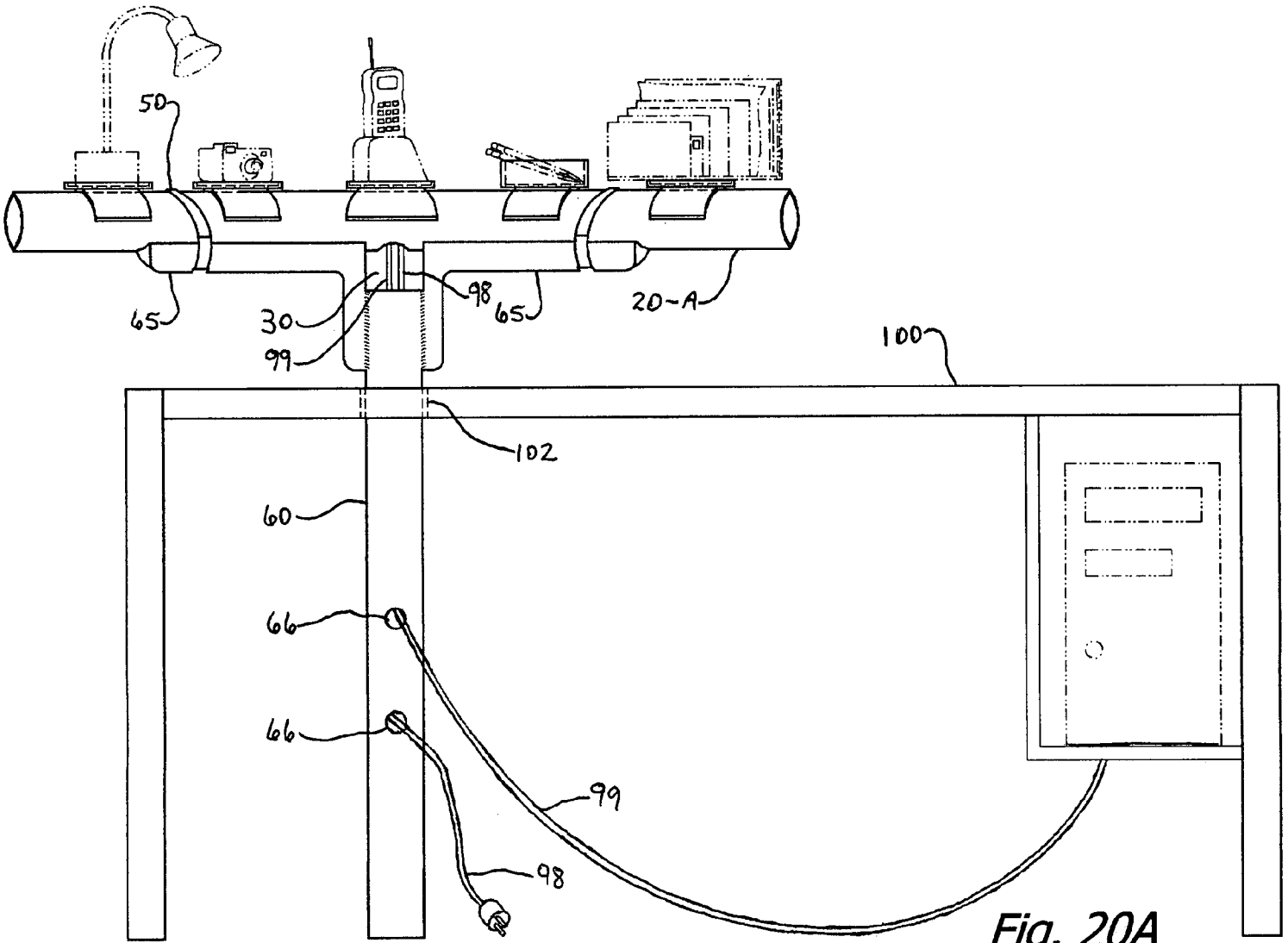
FIG. 20A is a front elevational view of an alternative method of support of the vertical support and illustrated wire routing method.

The vertical support 60 has a length generally corresponding to the desired height of the elongate-support 20. The vertical support 60 may be supplied in different lengths according to user requirements. Alternatively, the vertical support 60 may be supplied in a length considered adequate for most purposes and may be cut to shorter lengths by the user if required. Alternatively, the vertical support 60 may be made telescopic but if a telescopic vertical support is provided, it may interfere with the wire management functionality thereof by various ways such as yanking such wires if telescoped openly. The vertical support 60 if in use, is to be held preferably in a substantially vertical position. The vertical support 60 can be supported by a stand-base 80 further discussed later, or a chair attachment mechanism 120 also further discussed later. As another alternative, though FIG. 6 shows the vertical support supported on a stand-base 80, the vertical support 60 can also be directly supported by a floor if also supported in a plane cutout 102 for such vertical support 60 as shown in FIG. 20A.

The vertical support 60 provides a pair of extending bars 62 that cusp from the outer surface on the upper portion thereof from opposing sides. The extending bars 62 extend upwardly past the open end on the apex portion of the vertical support 60. Further integrated off of each extending bar 62 is an elongate-bracket 65. Each elongate-bracket 65 is congruent with the bottom portion of the elongate-support 20, and in the preferred embodiment the elongate-brackets are of yoke-like support structure. This is best seen in FIG. 6 and FIG. 10-B. Each of the elongate-brackets 65 provide a rectangular shaped notch 64 on the bottom side thereof near the end opposite from the integrated extending bars 62.

The vertical support 60 can provide one or more passage-holes 66, which if provided are preferably in the front, evenly spaced apart, and collinear. However, the passage-holes 66 do not need to be evenly spaced apart or even provided at all, thus allowing the user to customize the desired positioning of the passage-holes 66 by means such as a punch or by drilling the passage-holes 66 at a desired location or desired locations if any passage-holes 66 are desired at all by the user.

If the elongate-support 20 is engaged to the elongate-brackets 65, a wire access means is preferably provided, which in the illustrated embodiment is a void area 30 between the extending bars 62. This is best seen in FIG. 6. The void area 30 is of sufficient diameter to accommodate human fingers possibly reaching in to grab an electrical wire 98 and/or electronics wire 99 and/or the associated plugs.

Referring to FIGS. 2-8 and FIG. 10-B, if the elongate-support 20 is in use with the vertical support 60, the elongate-support 20 is preferably further engagement secured thereon the elongate-brackets 65 by at least one flexible restraint. Such flexible restraint can be a strap 50 which is preferably made of a flexible material such as flat nylon webbing. Though, in the illustrated embodiment a pair of straps 50 is used for better engagement security. However, additional straps 50 can be used for even better engagement security. In the illustrated embodiment, each strap 50 is fitted into the notch 64 of each elongate-bracket 65, and wrap around the elongate-support 20. The elongate-support 20 is engagement secured to the elongate-brackets 65 with the straps 50 by each of the straps 50 having a means for surface fastening 52, such as the well known hook and loop type fastener material, VELCRO. The flexible restraints can be of other forms. For example, rope could be used, but not all users would know how to tie effective knots that would hold the elongate-support 20 tightly to the elongate-brackets 65 while also having a fast convenient untying method.

The plane-cutout 102 for the vertical support 60 may be slightly different than a wire-aperture 101 in such kind of plane in that the plane-cutout 102 is preferably of a similar diameter and congruent shaped cross section as the exterior surface of the vertical support 60. Thus, helping to prevent the apparatus from leaning or swaying loosely. While the wire-aperture 101, if made in such plane preferably has a diameter according to the quantity of wires which via through such wire-aperture 101. Though illustrated in FIG. 1, the wire-aperture 101 is preferred when used in such a manner but not necessarily essential. For example, any wires can route around the back of the desk 100.

Figure 4:
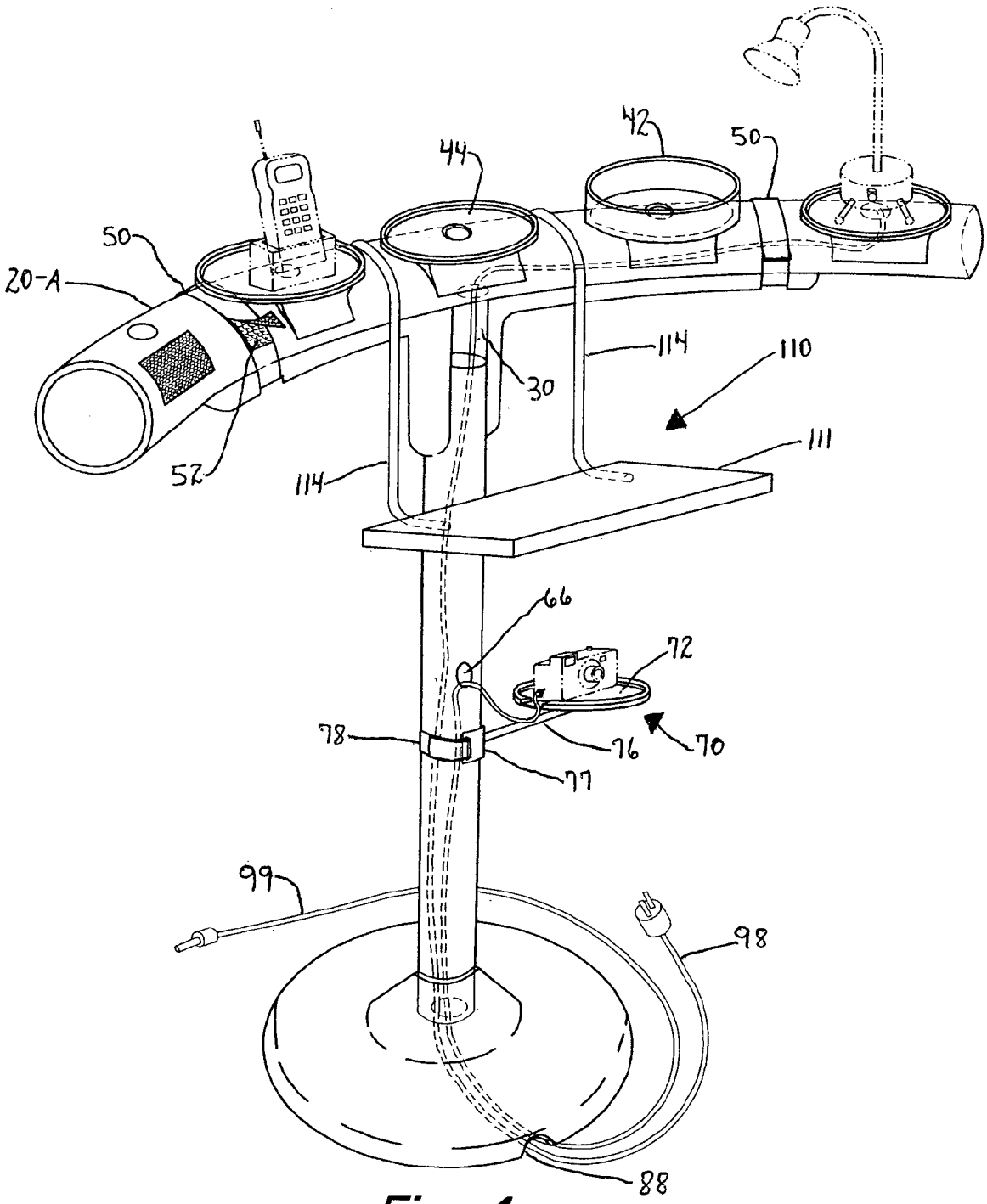
FIG. 4 is a perspective view of one of the preferred embodiments effected into a freestanding work station arrangement from such free standing organizer arrangement by adding a plane-attachment accessory, also showing a vertical support holder-attachment accessory.

Referring particularly to FIG. 4 and FIG. 12-C, the invention further includes a mutually engageable and disengageable optional holding means which can engage to the vertical support 60. Such optional holding means method can be a holder-attachment accessory 70 preferably made of a disc plane structure 72 made of a rigid, structural, light material such as aluminum or plastic providing an annular-like flange 74 extending perpendicularly upwardly at its outer end. The annular-like flange 74 would be completely annular if it did not have a channel-notch 73. At the center of this disc plane structure 72 on the bottom is a further integration of a rod 76 that extends downwardly diagonally. At the end of the rod 76 is a further integration of a yoke-like plate 77 congruent to the outer surface of the vertical support 60 of which portion that the yoke-like plate 77 engages. The yoke-like plate 77 is integrated in such a manner to the rod 76 that when engaged flush with the outer vertical support 60 surface, the disc plane structure 72 is leveled in a horizontal attitude. The yoke-like plate 77 provides a pair of vertical slits 75 at opposing horizontal end portions. A single mounting strap 78 preferably made of a material such as flat nylon webbing engages through the slits and around the outer surface of the vertical support 60 and engagement secured thereon by a hook and loop fastening engagement means 79. The channel-notch 73 is preferably provided on the portion of the annular-like flange 74 that is closest to the vertical support 60 when the yoke-like plate 77 engages to the vertical support 60. The flange notch 73 is preferably horizontally collinear to a vertical support passage-hole 66 if provided, and if the holder-attachment accessory 70 is engaged to the vertical support 60.

Referring particularly to FIG. 2, FIG. 10-A, and FIG. 10-B, the invention also includes a means for freestanding which can be an stand-base 80 made of a rigid, structural material. The stand-base 80 material is also preferably be made of a relatively heavier material such as steel or oak wood as opposed to a relatively lighter material such as aluminum or plastic. The stand-base 80 can be of any structurally stable shape to keep the engaging unit from falling over from normal usage. Such structurally stable shape can be formed from square, triangular, and various other shapes and such derivatives. The stand-base 80 in the illustrated embodiment has a generally circular contacting edge 81 at its outer end which makes contact with a horizontal surface that it is supported on. The stand-base 80 is preferably rounded upwardly and inwardly from the contacting edge 81 thereof to form a convexed upper side that is generally planar centrally, and a concaved under side that is generally planar centrally. The concaved side of the stand-base 80 faces down and is supported by a generally horizontal structure such as a floor or shelf of sufficient size if in use.

The stand-base 80 in the illustrated embodiment provides a braced-like support-neck 82 that projects from the convexed side central planar area. In the illustrated embodiment, the support-neck 82 is circularly rounded on its outer surface and is tapered or angled to have a relatively smaller diameter portion on its apex end thereof as to define a frustroconical projection. Alternatively, a support neck may be a separate part joined with fasteners such as screws or the like. The support-neck 82 is preferably of generally solid thickness except in the area of which a socket or engagement bore 84 is situated and aperture 86 thereof. The engagement bore 84 is situated from the central apex end of the support-neck 82 extending vertically downwardly to a general level of which the upper surface of the stand-base 80 would be without the support-neck 82, but not through the stand-base 80. The engagement bore 84 is designed to mate with the lower end of the vertical support 60. Thus, if the outer surface of the vertical support 60 is of round cross section, then the engagement bore 84 will be of round cross section having a similar diameter. If the outer surface of the vertical support 60 is of rectangular or of other cross section, the engagement bore 84 will have a shape corresponding to it. On the central bottom of the engagement bore 84 is preferably an annular shaped aperture 86 that extends through the bottom of the stand-base 80 to allow electrical wires 98 and electronics wires 99 and associated plug types to pass through such aperture 86.

The stand-base 80 also preferably provides at least one via-port 88 at its outer contacting edge 81 that is preferably arch or half-circle shaped which will allow at least one electrical wire 98 and electronic wires 99 to pass through when the stand-base 80 is supported by a horizontal surface. Though most of the drawings depict the via-port 88 on the frontal portion of the stand-base 80, such drawings are for easier visualization reference, and as shown in FIG. 6, the via-port/s 88 can be adjusted by the user to a general direction that such wires are leading to or from.

The lower end of the vertical support 60 is preferably mutually engageable and disengageable and is pivotally supported inside of the engagement bore 84 if the stand-base 80 is in use. If the vertical support 60 is indeed desired to be pivotally supported inside of the engagement bore 84, a lubricant such as grease can be applied inside of the engagement bore 84 on the surface thereof if the vertical support 60 is desired to pivot more easily. Alternatively, the stand-base 80 can be joined rigidly to the lower end of the vertical support by the user if desired, particularly once the user has the unit set in a desired position and elects to use the apparatus in such manner permanently. The lower end of the vertical support 60 can be more permanently joined to the engagement bore 84 with the use of an adhesive such as polyurethane glue if desired. The stand-base 80 in the illustrated embodiment when used in conjunction with the vertical support 60 defines a freestanding means that also hides and protects wires and diverges wires toward a user needed or desired location.

Figure 5:
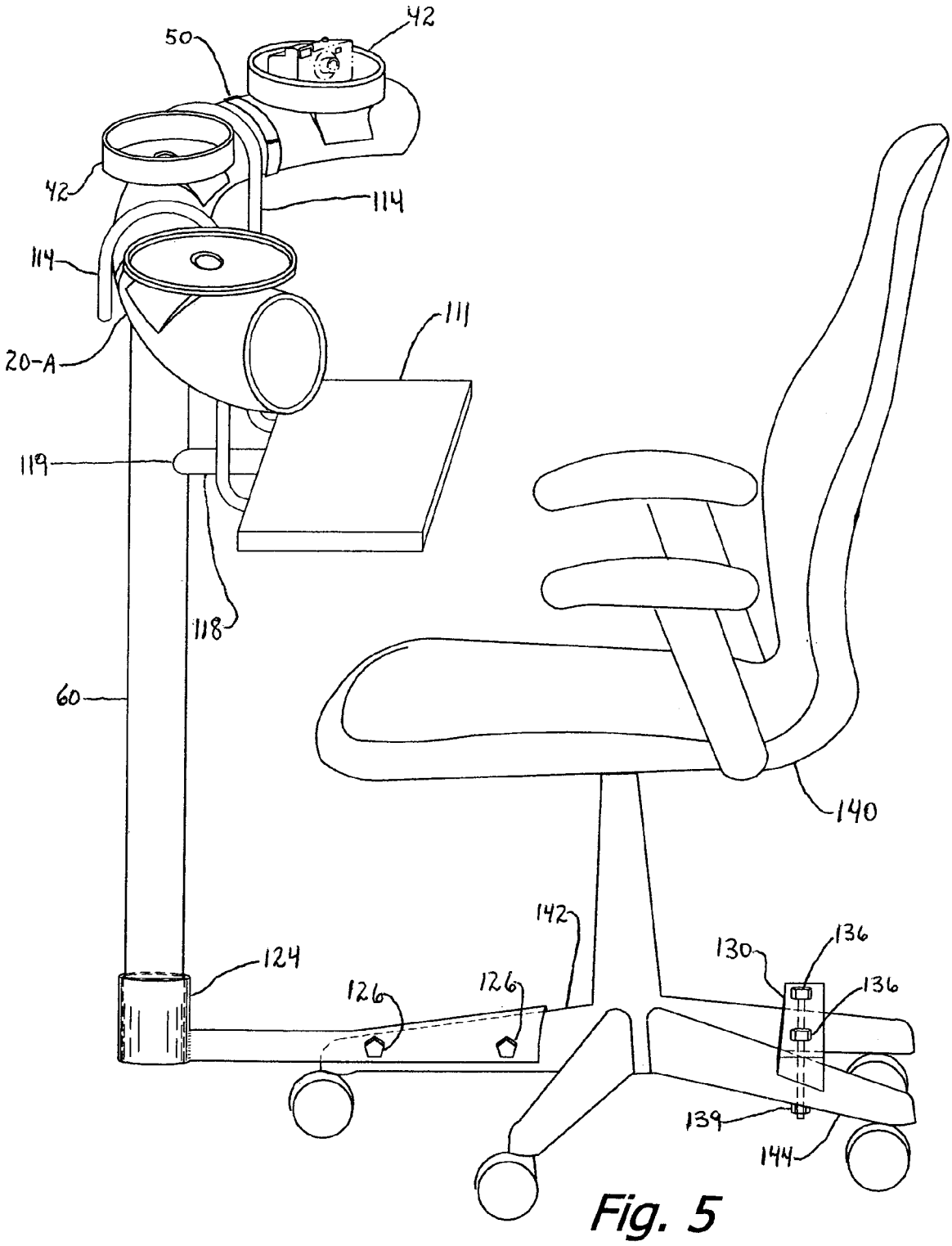
FIG. 5 is a perspective view of one of the preferred embodiments effected into a mobile work station mode from such mobile organizer mode by a turn of the revolving mechanism of the chair and adding the plane-attachment accessory.

Referring particularly to FIG. 4, FIG. 5, and FIG. 15, the invention further includes a plane-attachment 110 that can be used in a desk-like manner. The plane-attachment 110 preferably engages to the elongate-support 20 by a pair of hook-rods 114 of which the upper hooking portions engage preferably loosely on the elongate-support 20 and are supported by the elongate-support 20 if engaged. This is best seen in FIG. 4 and FIG. 5. Referring now particularly to FIG. 15, the hook-rods 114 are hook shaped and preferably made of a rigid, structural, light material such as plastic or aluminum. The elongated portion of the hook-rods extend downwardly of a length to be of approximate height that is of a height consistent with common office desks 100 if engaged to the elongate-support 20. The hook-rods 114 each provide a bend 113 on the lower portion thereof that angles the generally opposite direction of the hook portion of the hook-rods 114. The bends 113 are so angled to generally level horizontally the plane structure 111 if engaged for use. Further integrated from each bend 113 is a male tenon 112.

The plane-attachment 110 includes plane-structure 111 preferably made of a rigid, structural, light material such as plastic. The plane-structure 111 in the illustrated embodiment is shelf shaped. However, many other shapes are possible and practical such as oval or rounded type shapes. The plane structure 111 provides a pair of female mortises 116 on the illustrated rear side thereof. The male tenons 112 of the hook-rods 114 are joined to the female mortises 116. An adhesive agent such as polyurethane glue can be used to further secure the female mortises 116 to the male tenons 112.

To keep the plane structure 111 from swaying back and forth, or slipping to the left or right, a brace-rod 118 is joined to the plane structure 111. The brace-rod 118 is rod shaped and preferably made of a rigid, structural, light material such as plastic or aluminum. The brace-rod 118 has a joint-end 117 functioning like a tenon. A brace-rod mortise 115 is provided in the plane structure 111 evenly spaced between the female mortises 116 for the male tenons 112. The brace-rod 118 is joined to the plane structure 111 at its joint-end 117 to the brace-rod mortise 115. An adhesive agent such as polyurethane glue can be used to further secure the brace-rod mortise 115 to the joint-end 117 of the brace-rod 118. Opposite from the joint-end 117 of the brace-rod 118, is a yoke-like end 119. The yoke-like end 119 is designed to mate with a portion of the outer surface of the vertical support 60, which such portion of the outer surface of the vertical support 60 is that of such yoke-like end 119. The yoke-like end 119 engages and is supported by the outer surface of the vertical support 60 if the desk-like engagement accessory 110 is engaged. This is best seen in FIG. 5.

Figure 16:
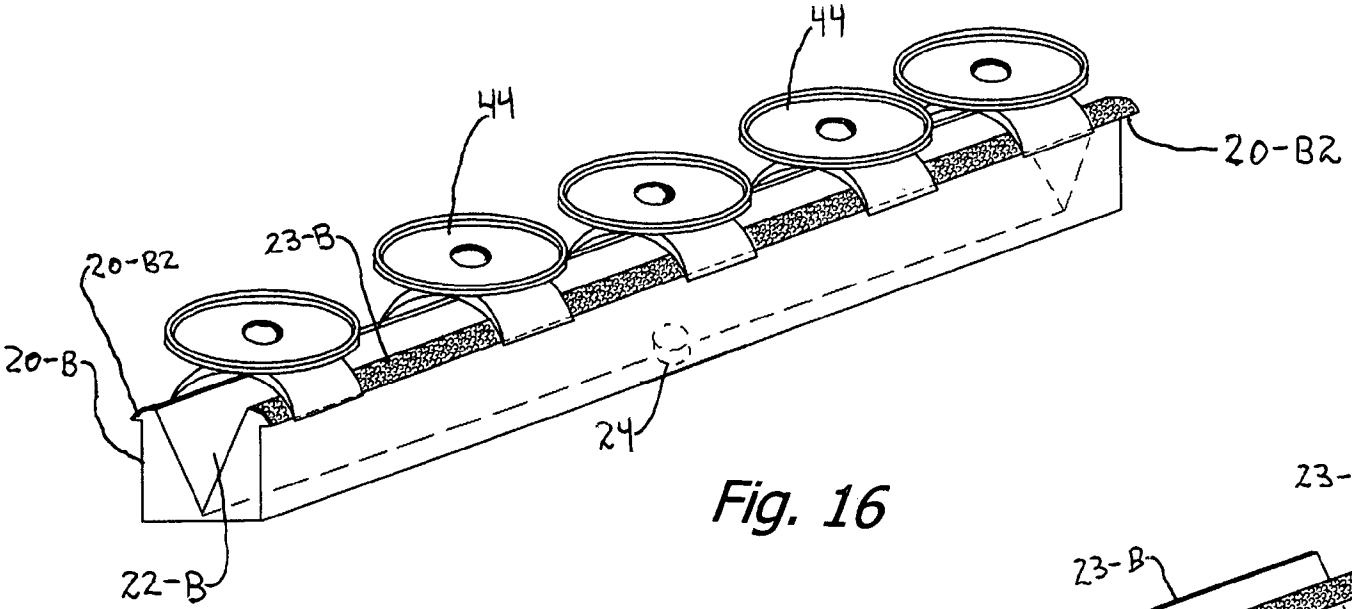
FIG. 16 is a perspective view of an alternative embodiment of the elongated support as a channeled track.
Figure 17:
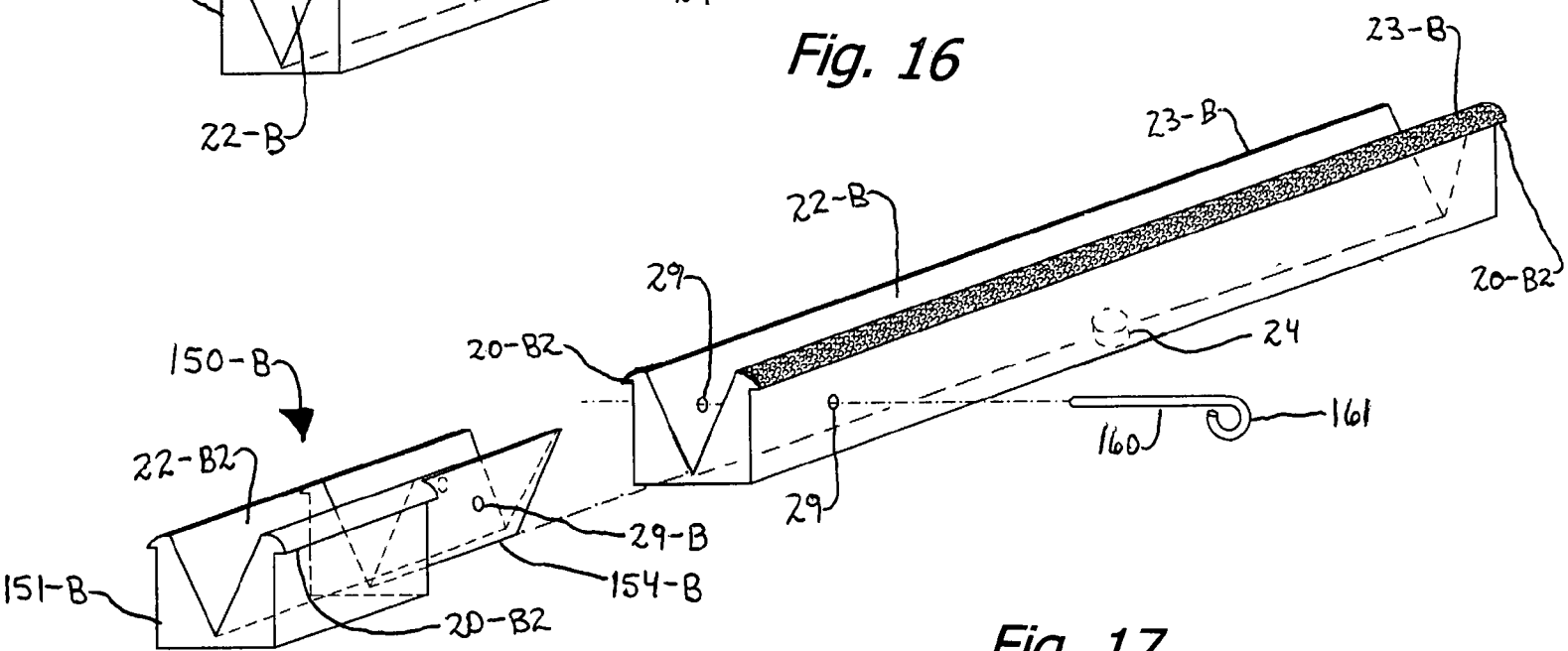
FIG. 17 is an exploded perspective view thereof with a means for extension and extension accessory attachment.

If the plane-attachment 110 is to be used with an elongate-support 20 of a non-curved or non-bent configuration such as the embodiments illustrated in FIG. 16 and FIG. 17, then the brace-rod 118 will have to be of a relatively shorter longitudinal length than so if such elongate-support 20 had a curved configuration such as described for the cylindrical-tube 20-A. Or, the hook portions of the hook-rods 114 will have to be of a relatively larger curving diameter if used on a non-bent or non-curved elongate-support 20 configuration than so if used on a curved configuration such as described for the cylindrical-tube 20-A.

The invention also includes an extension attachment accessory 150 as shown in FIG. 8. The extension attachment accessory 150 is preferably made of a rigid, structural, light material such as aluminum or plastic. Referring now to FIG. 13, the extension member 151 is cylindrical in the illustrated embodiment to ornamentally match the design of the cylindrical-tube 20-A. However, the extension member 151 will preferably match the design of any such tube structure. The extension member 151 in the illustrated embodiment has substantially the same outside diameter as the cylindrical-tube 20-A outside diameter. However, the extension member 151 will have approximately double the thickness of the cylindrical-tube 20-A. Thus, the extension member 151 will have a relatively smaller inside diameter compared to a relatively larger inside diameter of the cylindrical-tube 20-A. The extension member 151 preferably has continuity of substantially the same curvature as that of the cylindrical-tube 20-A if curvature is indeed provided on such cylindrical-tube 20-A. Or if curvature is provided on any such tube structure. The extension member 151 is of a longitudinal length that is adequate to properly grant at least one additional holding means 40.

The extension member 151 provides a tenon-neck 154 that projects from approximately half of the thickness and from the inside surface of the extension member 151. The tenon-neck 154 projects leftwardly in the illustrated embodiment. The tenon-neck 154 is designed to mate with the elongate-support 20 if such elongate-support 20 is of a tube structure. Thus, the outside diameter of the tenon-neck 154 will have a similar diameter as the inside diameter of elongate-support 20 tube structure. And the outside surface of cross section of the tenon-neck 154 will be of congruent shape as the inside surface of cross section of such tube structured elongate-support 20. The tenon-neck 154 is of a longitudinal length that is adequate to securely engage such extension attachment accessory 150 to such tube structured elongate-support 20 for usage.

The extension attachment accessory 150 is preferably open ended on both sides, and can also provide at least one porthole 22 in the same manner as the cylindrical-tube 20-A if the extension attachment accessory 150 is indeed tubular. If the extension attachment accessory 150 is tubular, fastening tapes 23 can be placed for at least one holding means 40 in the same manner as for the cylindrical-tube 20-A. In the illustrated embodiment, as shown in FIG. 8 and FIG. 13, the extension attachment accessory 150 is shown to extend apparatus rightwardly. However, it is obvious to those skilled in the art as to how to make an extension attachment accessory 150 that extends the apparatus leftwardly as well.

Figure 3:
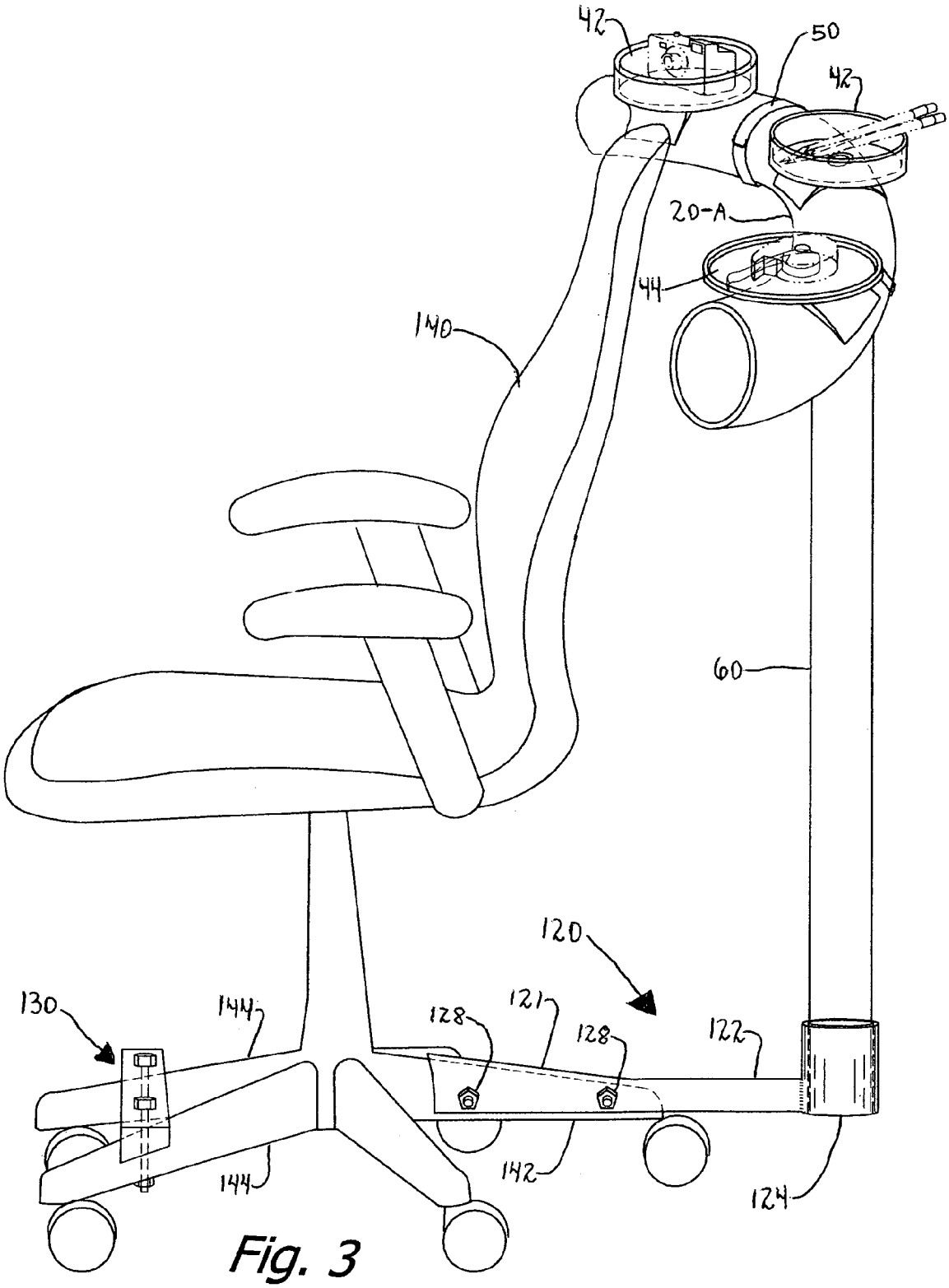
FIG. 3 is a perspective view thereof engaged to the vertical support of which is further engaged to a mounting collar of which is joined to an office chair to effect a mobile organizer arrangement.
Figure 11:
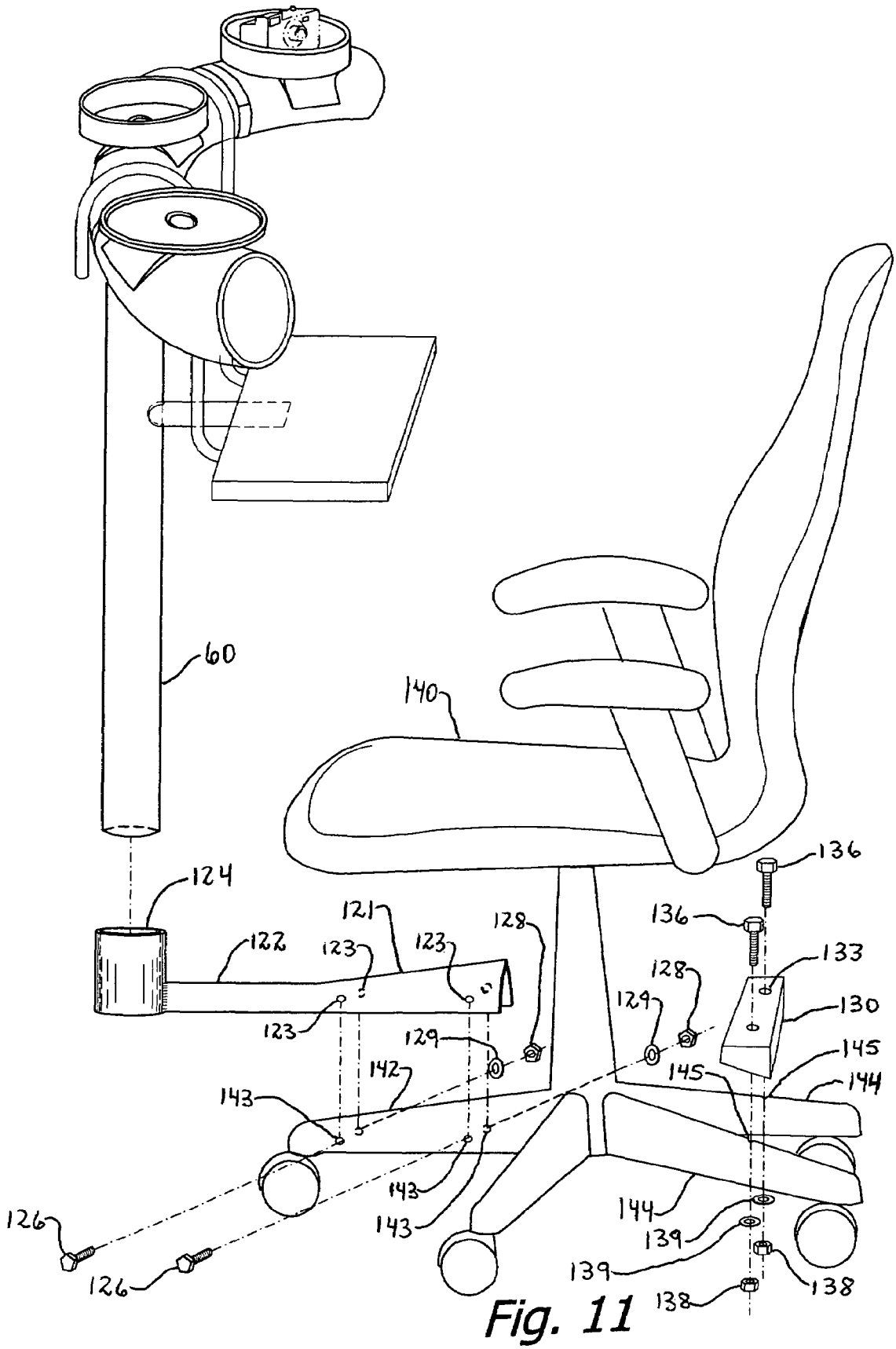
FIG. 11 is an exploded perspective view of the chair attachment means, shown preferably having a counterweight.

The invention also includes a chair attachment means. Referring to FIG. 3, FIG. 5, and FIG. 11, the chair attachment means attaches to a task chair 140 or the like seating device. The chair attachment mechanism 120 in the illustrated embodiment attaches to the base of such chair is made including a saddle-jacket 121 which is made of a rigid, structural, and preferably light material such as aluminum or plastic. The saddle-jacket 121 is designed to mate and embrace with specific selected manufactured models selected chair leg 142. Thus, a variety of chair attachment mechanisms 120 may have to be made according to which manufacturers and models of chairs are chosen to be accommodated with the chair attachment mechanism 120. And the saddle-jacket 121 will have congruent shape with the upper and vertical sides of the selected chair leg 142 and have similar diameter of the upper and vertical sides of the selected chair leg 142. The saddle-jacket 121 extends across the greater majority of the chair leg 142 upon which it is. The saddle-jacket 121 provides a pair of holes 123 on each of its vertical sides which will align with corresponding-holes 143 on each of the vertical sides of the selected chair leg 142. The holes 123 on the saddle-jacket 121 and the corresponding-holes 143 on the selected chair leg 142 are of substantially the same diameter, and of proper diameter for a bolt 126 to pass through. The user can drill the corresponding-holes 143 on any selected chair leg 142 for use with the proper chair engagement mechanism 120. Alternatively, a chair manufacturer can pre-drill the corresponding-holes 143 or provide a proper chair attachment mechanism integrated to a chair leg.

Extended off of the saddle-jacket 121 is an extension neck 122 which has a bend according to the specific manufacturers chair leg angle which will provide the end of the extension neck 122 opposite from the end integrated to the saddle-jacket 121 to be substantially horizontally level when the saddle-jacket 121 is joined to the selected chair leg 142. The extension neck 122 is preferably of generally the same shape as the saddle-jacket 121, but of a relatively smaller diameter. On the end of the extension neck 122 opposite from the end integrated to the saddle-jacket 121 is a mounting collar 124. The mounting collar 124 is designed to mate with the lower end of the vertical support 60 if in use. Thus, if the outer surface of the lower end of the vertical support 60 is of round cross section, then the inner surface of the mounting collar 124 will be of round cross section having a similar diameter. If the outer surface of the vertical support 60 is of rectangular or of other cross section, then the inner surface of the mounting collar 124 will have a shape corresponding to it. The outer surface of the mounting collar 124 is preferably the same shape as the inner surface of the mounting collar 124. The mounting collar 124 is of sufficient height to properly securely engage the vertical support 60 inside of with normal use. Alternatively, the vertical support 60 can be joined in a more rigid manner to the mounting collar 124 with the use of an adhesive such as polyurethane glue. However, if joined in a rigid manner, the apparatus will be more likely to be limited to such embodiment with a chair.

The saddle-jacket 121 is joined rigidly to the selected chair leg 142 by a pair of bolts 126 that pass through the holes 123 in the saddle-jacket and corresponding-holes 143 in the selected chair leg 142. A washer 129 is placed on each of the bolts 126 and butts up against the opposite side of the selected chair leg 142 that each of the heads of the bolts 126 butts up against. Then, a pair of nuts 128 is securely tightened to each of the washers 129, as the washers are securely tightened to the selected chair leg 142.

The invention also includes a means to provide stability to a chair not in use with weight beyond the fulcrum. Such means can be a tie down method or wedging the chair base under the underside of appropriate height furniture that has an underside lifted off of the floor. But in the preferred embodiment, to further stabilize the chair 140 from falling over if a person is not sitting in the chair and the back of the chair is positioned on generally the same side of the fulcrum as the engaged apparatus, a counterweight 130 is preferably joined to the opposing chair leg 144 on the opposite side of the fulcrum of the selected chair leg 142. Or, if the base has an odd number of chair legs such as five chair legs, the counterweight 130 will be joined to the two opposing chair legs 144 which are most opposite of the fulcrum of the selected chair leg 142 upon which the chair engagement mechanism 120 is joined. The counterweight 130 is preferably made of a rigid, structural, and relatively heavy material such as iron. The counterweight 130 is preferably generally rectangular shaped and planar on all six sides. However, the counterweight 130 is preferably angled such that the apex side thereof is substantially horizontally level if the counterweight is joined to the opposing chair leg/s 144. The counterweight 130 in the illustrated embodiment has a pair of bolt-holes 133 located symmetrically from the apex side of the counterweight 130 that extend generally vertically downwardly through the counterweight 130.

The opposing chair legs 144 upon which the counterweight 130 is, also each provide a corresponding-aperture 145. Or, if the counterweight 130 is on a single opposing chair leg 144, a pair of corresponding-apertures 145 will be provided on such single opposing chair leg 144. As shown in FIG. 11, the pair of bolt holes 133 provided in the counterweight 130 align with the corresponding-apertures 145 in each of the opposing chair legs 144 as the example is shown with a chair 140 on a base of five legs. The counterweight 130 is joined rigidly to the opposing chair legs 144 by a pair of counterweight-bolts 136 that pass through the bolt holes 133 of the counterweight 130 and the corresponding-apertures 145 on each of the opposing chair legs 144. A counterweight-washer 139 is fitted on to each counterweight-bolt 136 and butts up against the underside surface of each of the opposing chair legs 144. Then, a pair of counterweight nuts 138 is securely tightened to each of the counterweight-washers 139, as the counterweight-washers 139 are securely tightened to each of the opposing chair legs 144.

The counterweight 130 is preferably placed as far apart from the chair attachment mechanism 120 on the opposing chair legs 144 as practically possible, but without interfering with the wheels or mobility of such opposing chair legs 144. The counterweight 130 will be of a size that will provide an adequate and safe amount of weight to the side of the fulcrum which opposes the side on which the chair attachment mechanism 120 is joined, so the apparatus including any accessories and items used with such can be supported from the chair attachment mechanism 120, even if a person is not using such chair 140 or the apparatus. And when no persons are using the chair with such attached apparatus, such chair will not fall off of its intended base.

If the opposing chair leg/s 144 is recessed inwardly on the underside and does not have a planar surface unto which the counterweight washers 139 can join generally flush, a filler agent such as hardened epoxy resin (not shown) can be used between each of the counterweight washers 139 and any such recess or channel not allowing full contact of the generally planar surface of the counterweight washer 139. Thus, the counterweight washers 139 can join more flush to the underside of the opposing chair leg/s 144 and provide better joinery.

As previously described, a majority of embodiment parts of the invention can have a preferred embodiment in which the materials used are lightweight. This is to make moving, interchanging, and converting the apparatus as easy as practically possible and applicable to as many persons as possible. However, a preferred embodiment can also be of heavier materials. Representatively, since the décor style in many offices, particularly executive offices and home environments is of wood or wood-composite materials décor, it is fine in most cases to make many parts of wood or wood-composite material. For example, to make the plane structure 111 of the plane-attachment 110 of a material such as oak wood as opposed to a relatively lighter material such as plastic, would make the plane-attachment 110 heavier to mutually engage and disengage. However, some users may prefer the advantage of such an apparatus that is accommodating to an elegance or décor style in exchange for the disadvantage of heavier physical tasks such as engaging or disengaging the plane-attachment 110. Also for example, in a high ranking executives office, elegance and décor style is of great importance to make a necessary impression on clients and associates. Furthermore, if the elongate-support 20 is attached to a desk 100 in a permanent manner, appearance and elegance is of more importance than if such was used in a more removable manner. Thus, the materials used to make the apparatus, including all parts and accessories can vary greatly, and a manufacturer can make the apparatus, parts, and accessories of various materials to accommodate differing users needs or desires.

As previously described, in the illustrated view in FIG. 1, the elongate support 20 is engaged to a horizontal plane surface by gravity. However, the elongate support 20 can also be further engagement secured thereon by fastening tapes such as VELCRO tapes (not shown attaching the elongate support to the horizontal plane surface) or more permanently joined with rigid fasteners such as screws (not shown) for example, by penetrating the screws through such horizontal plane from the underside thereof with such screws penetrating the elongate support 20 through the underside thereof. However, such screws should not penetrate so deep inside of the elongate support 20 that such screws would substantially interfere with any wires which may be inside thereof.

FIGS. 16-19—ALTERNATIVE EMBODIMENTS

Figure 18:
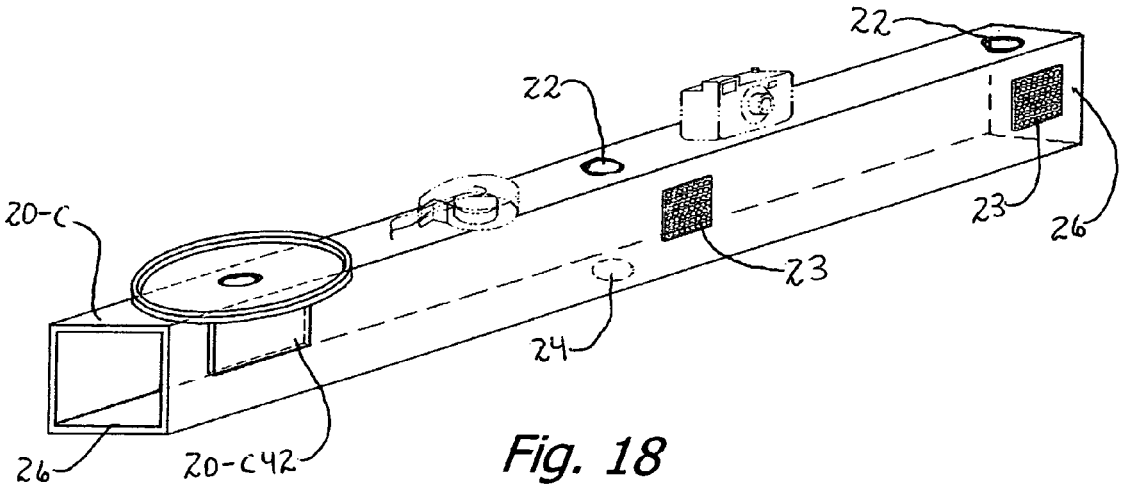
FIG. 18 is a perspective view of an alternative embodiment of the elongated support as a squared tube.

There are many and various possibilities in regard to the embodiment of the elongate-support 20 that will accomplish substantially the same results in substantially the same manner. Disclosed in this alternative embodiment section of the description is two alternative embodiments that offer petty advantages and disadvantages comparatively to the cylindrical-tube 20-A. An example of a variation of the preferred embodiment of the elongate-support 20 is a squared-tube 20-C as shown in FIG. 18. The squared-tube 20-C can have an equivalent holding means 40, and in the illustrated embodiment as shown in FIG. 18, the holding means 40 has an equivalent attachment mechanism to the mounts 42-C or 44-C for the holding means 40 of the cylindrical-tube 20-A. Such equivalent attachment mechanism can be as the yoke-mounts 20-C42 designed to fit on the squared-tube 20-C. Those skilled in the art would know how to make such yoke-mounts 20-C42 or other attachment mechanism, particularly after reading the description about the holding means 40 which are attachable to the cylindrical-tube 20-A.

Like the cylindrical-tube 20-A, the squared-tube 20-C is preferably made of a rigid, structural, light material such as aluminum or plastic. Because the squared-tube 20-C is generally planar on the underside, it does not need curvature or bends to be able to be directly supported on a horizontal structure. However, the squared-tube 20-C can have similar curvature as the cylindrical-tube 20-A, and such curvature may be desired for the squared-tube 20-C, as such curvature configuration offers petty advantages and disadvantages comparatively to an unbent or non-curved configuration (discussed later). The squared-tube 20-C also preferably provides at least one aperture, opening or passage more defined as a port-hole 22 for reference purpose, which is preferably annular shaped and of sufficient diameter for at least one electrical wire 98 or electronics wire 99 and associated plug to pass through such port-hole 22. And preferably has fastening tapes 23 placed adjacently in the same manner as the cylindrical-tube 20-A. The squared-tube 20-C also preferably provides at least one aperture, opening or passage more specifically defined as a via-passage 24 for reference purpose located centrally on the underside thereof. However, as described for the cylindrical-tube 20-A, any port-hole/s 22 or via-passage/s 24 do not need to be included. Thus, allowing the user to custom locate any port-hole/s or via-passage/s and quantity thereof. And the fastening tapes 23 should not be joined if joining the holding means 40 in a more rigid manner such as with polyurethane glue or fasteners such as screws.

Because there is not a curvature configuration in the particular embodiment of the squared-tube 20-C illustrated, a center point reference is not needed as described for the preferred curvature of the cylindrical-tube 20-A. Thus, the open ends 26 for the particular squared-tube 20-C illustrated are not cut towards or to align with a center point. The open ends 26 in the illustrated embodiment of the squared-tube 20-C are preferably cut substantially squared off.

An advantage of the squared-tube is that in some cases, the attachable holding means 40 is not necessary because the apex side is generally planar. Thus, as shown in FIG. 18, some items can be placed directly on the squared-tube 20-C. However, because no retaining means is provided when using the squared-tube 20-C in such a manner, items can easily get knocked off, or in some cases, roll off of the squared-tube 20-C if not substantially leveled horizontally. This is particularly not desirable if the apparatus is mobilized. Though a retaining means such as a flange could be integral to the squared-tube 20-C, such equivalent structure is not preferred because it would offer less user controlled organization. And if only one single flange was provided, for example, at the outer edge of the apex side of the squared-tube 20-C, the equivalency of having a plurality of organizational areas is not preferred, because the plurality of attachable holding means 40 in the preferred embodiment can be moved with items already placed inside of such holding means. This is particularly helpful with items placed numerously together such as paperclips or pens and pencils sets.

As previously described, the squared-tube 20-C has some possible minor advantages compared to the cylindrical-tube 20-A. However, the cylindrical-tube 20-A also has possible advantages compared to the squared-tube 20-C. For example, because cylindrical-tubes have generally round outer surface cross section, a user can attach some items with greater control of angle attachment of the 360 degrees of cross section. And because the apparatus is preferably optional accessory accommodating, any possible future accessories invented may be able to be attached with greater control of angle, as opposed to the squared-tube 20-C having only four possible attachment angles on its outer surface cross section.

Another example of the elongate support 20 is a channeled-block 20-B such as that shown in FIG. 16 and FIG. 17. The channeled-block 20-B in the exemplary structure is made of a rigid, structural, light material such as aluminum or plastic. In the particular embodiment illustrated in FIG. 16, the channeled-block 20-B is formed of a squared block at its lower portion having a generally planar underside and generally planar outer vertical sides. In the illustrated embodiment, cusped from each of the longitudinal vertical sides is a lip-track 20-B2 at the upper end thereof. Each of the lip-tracks 20-B2 forms a semicylinder shape of a generally quarter-circle exterior surface. And in the illustrated embodiment the lip-tracks 20-B2 are so positioned that the mounts described for the holding means 40 of the cylindrical-tube 20-A would be able to attach substantially flush at the area where corresponding fastening tapes 42-E or 44-E are preferably placed as described for such mounts 42-C or 44-C. However, in the particular embodiment illustrated, the channeled track 20-B does not have a curvature configuration such as described for the cylindrical-tube 20-A. Thus, the mounts 42-C or 44-C do not have such curvature configuration as illustrated with the illustrated cylindrical-tube 20-A. Extending coaxially through the longitudinal length of the block in the particular embodiment illustrated, is a generally syncline or V-shaped sluice, elongate cavity, or channel 22-B. Although, the channel 22-B can also be U-shaped, semicylinder shaped, squared, or of any shape that will allow at least one electrical wire 98 and/or electronics wire 99 passage through such channel 22-B. The channeled-block 20-B also preferably provides at least one aperture, opening or passage more specifically defined as a via-passage 24 for reference purpose located centrally on the underside thereof. However, as described for the cylindrical-tube 20-A, the via-passage/s 24 does not need to be included. Thus, allowing the user to custom locate any via-passage/s 24 and quantity thereof.

In the particular embodiment illustrated, an elongated fastening tape 23-B joins the longitudinal length of each lip-track 20-B2. However, the elongated fastening tapes 23-B should not be joined if joining the holding means 40 in a more rigid manner such as with polyurethane glue or fasteners such as screws. In the particular channeled block illustrated, the holding means 40 now also help protect and hide any possible electrical wires 98 and/or electronics wires 99 running through such channeled-block 20-B. The holding means 40 can either be engaged with fastening tapes or more permanently joined to the lip-tracks 20-B2 with an adhesive such as polyurethane glue or with rigid fasteners such as screws in substantially the same manner as previously described for the cylindrical-tube 20-A.

Like the squared-tube 20-C, the channeled-block 20-B as previously mentioned is generally planar on the underside, and thus, the illustrated channeled-block 20-B does not need curvature or bends to be able to be directly supported on a horizontal structure. However, the channeled-block 20-B can have similar curvature as the cylindrical-tube 20-A, and such curvature may be desired for the channeled-block 20-B, as such curvature configuration offers petty advantages and disadvantages comparatively to an unbent or non-curved configuration (discussed later). Because there is not a curvature configuration in the particular embodiment of the channeled-block 20-B illustrated, a centerpoint reference is not needed as described for the preferred curvature of the cylindrical-tube 20-A. In the illustrated embodiment of the channeled-block 20-B, such ends thereof at the each opposing longitudinal length thereof, are preferably cut substantially squared off.

Referring to FIG. 16, though the holding means are shown including a hole 44-D, as viewable between each of the plate-like holders 44 is ample space for wire passage. Thus, even more accentuated now, no such hole 44-D or 42-D is needed. However, such hole 44-D or 42-D used can hide and protect any wires extending from devices slightly better in some instances.

Referring to FIG. 17, the channeled-block 20-B can also have an alternative extension attachment accessory 150-B that functions in a similar manner as the previously described extension attachment accessory 150. The alternative extension attachment accessory 150-B is preferably made of a rigid, structural, light material such as aluminum or plastic. In the particular illustrated embodiment as shown in FIG. 17, the alternative extension member 151-B is of a generally matching shape as the channeled-block 20-B to ornamentally match the design of the channeled-block 20-B. However, in the illustrated embodiment the alternative extension member 151-B is of a relatively shorter longitudinal length than the channeled-block 20-B, and has a relatively smaller diameter channel 22-B2 than the relatively larger diameter of the channel 22-B of the channeled-block 20-B. If the channeled-block 20-B is made of a curved configuration, the alternative extension member 151-B will preferably have continuity of substantially the same curvature as that of the channeled-block 20-B. The alternative extension member 151-B is of a longitudinal length that is adequate to properly grant at least one additional holding means 40.

The illustrated alternative extension member 151 provides a projected generally V-shaped channeled-neck 154-B that projects from a layer of thickness and from the inside surface of the channel 22-B of the alternative extension member 151-B. The channeled-neck 154-B is of a thickness that is adequate to safely support any weight which will be placed on the illustrated alternative extension member 151-B. The channeled-neck 154-B projects rightwardly in the illustrated embodiment. The channeled-neck 154-B is designed to mate with the channel 22-B of the channeled-block 20-B. Thus, the underside diameter of the channeled-neck 154-B will have a similar diameter as the surface of the channel 22-B of the channeled-block 20-B. And the underside surface of cross section of the channeled-neck 154-B will be of congruent shape as the surface of cross section of the channel 22-B of the channeled-block 20-B. The channeled-neck 154-B is of a longitudinal length that is adequate to safely engage such alternative extension attachment accessory 150-B to such channeled-block 20-B for usage.

Of course, such described channeled neck 154-B can not enable engagement of itself alone. Though, there are various ways to engage the channeled-neck 154-B to the channel 22-B of the channeled-block 20-B. For example, if the weight which will be placed on the alternative extension member 151-B is not too heavy, fastening tapes such as VELCRO tapes may be adequate to engage such channeled-neck 154-B to the channel 22-B of the channeled-block 20-B. However, in the illustrated embodiment of FIG. 17, a pin 160 is used to safely engage the channeled neck 154-B to the channel 22-B of the channeled-block 20-B. This can be done by either the user or the manufacturer making drilled-holes 29 through the channel 22-B of the channeled-block 20-B and corresponding drilled-holes 29-B through the channeled-neck 154-B. The drilled-holes 29 and the corresponding drilled-holes 29-B are substantially collinear in alignment to allow the pin 160 to engage through such drilled-holes 29 and corresponding drilled-holes 29-B when the channeled-neck 154-B is engaged to the channel 22-B of the channeled-block 20-B. The pin 160 is preferably made of a rigid, structural material such as metal or plastic. The pin 160 is rod shaped having a bend forming a generally circular finger-handle 161 at one end thereof. The pin 160 engages through the drilled-holes 29 and corresponding drilled-holes 29-B at its rod portion and the finger-handle 161 forms a butt joint to the frontal outer vertical side of the channeled-block 20-B if the illustrated alternative extension member 151 is engaged for use.

The holding means 40 can either be engaged with fastening tapes or more permanently joined to the alternative extension member 151-B with an adhesive such as polyurethane glue or with rigid fasteners such as screws in substantially the same manner as previously described for the cylindrical-tube 20-A.

An advantage of the channeled-block 20-B is that it offers easier access to wires and easier enablement to run wires through the apparatus. However, while the holding means 40 can protect and hide such wires, the holding means 40 or other covering means must always be attached to the channeled-block 20-B to properly protect and/or hide such wires that run through such channeled-block 20-B. Additionally, tube structures, particularly cylindrical tube structures are a common mold and well defined in the mechanical manufacturing industry. Thus, at the time of submittal of this patent application, tube structures are generally financially more cost effective to manufacture or purchase from a manufacturer than many other possible structures such as the channeled-block 20-B illustrated. And thus, a tube structured elongate-support 20 can provide the user with a more financially economical apparatus as opposed to such illustrated channeled-block 20-B. Additionally, tube structures, particularly cylindrical tube structures tend to be more sturdy for rugged use, and offer more angles of attachment for possible future designed accessories.

To address a curved or bent configuration as opposed to a non-curved configuration of the elongate-support 20, a curved configuration of can offer a more accommodating reach to items organized on such elongate-support 20. However, a non-curved configuration of such elongate-support 20 can possibly provide more work area and/or less interfered work area. A curved configuration of the elongate-support 20 can require less longitudinal length of the extension-neck 122 of the chair attachment mechanism 120 if the elongate-support 20 will be used in conjunction with a chair 140.

Figure 19:
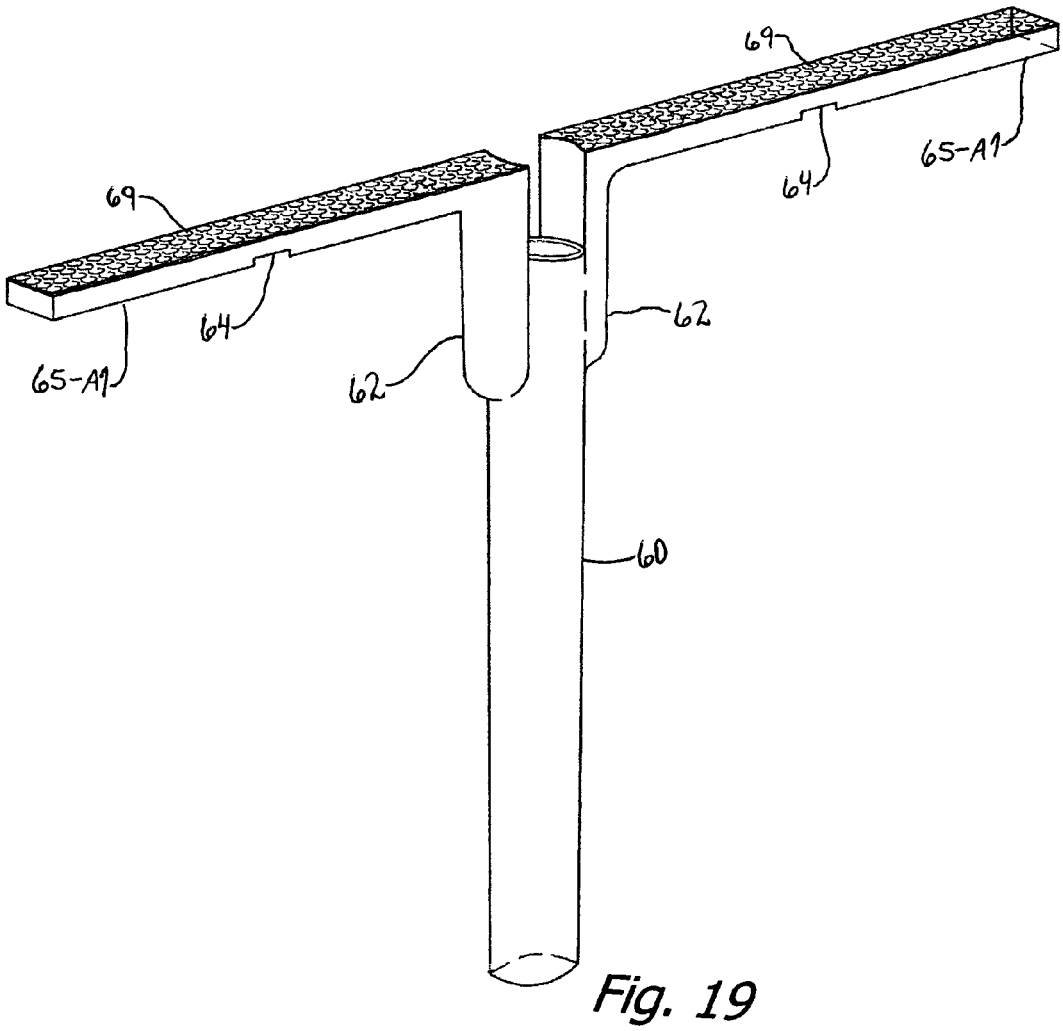
FIG. 19 is a perspective view of an alternative embodiment of the vertical support for such alternative embodiments as shown in FIGS. 16, 17, and 18.

Referring to FIG. 19, if the embodiment of the elongate-support 20 includes a planar underside such as the illustrated squared-tube 20-C or the illustrated channeled-block 20-B, then the embodiment of the supporting brackets should more accommodating to properly support such structure. The embodiment of the illustrated alternative substantially vertical support is nearly the same as the previously described vertical support. However, the illustrated alternative elongate-brackets 65-A1 are generally rectangular shaped and planar on the apex side thereof. To better securely engage an elongate-support 20 that has a generally planar underside to the illustrated alternative elongated-brackets 65-A1, an elongated covering-fastening-tape 69 can be joined to the apex side of each of the alternative elongate-brackets 65-A1. Then, a corresponding elongated-fastening-tape can be joined to the underside of such elongate-support 20 that has a planar underside (not shown).

Operation Clarifications

While the majority of usefulness and operation of the invention is obvious after inspecting the drawings and reading the above descriptions including the background, summary, brief description of the drawings and detailed description sections, some uses and operations are explained here for clarity purpose.

Figure 20B:
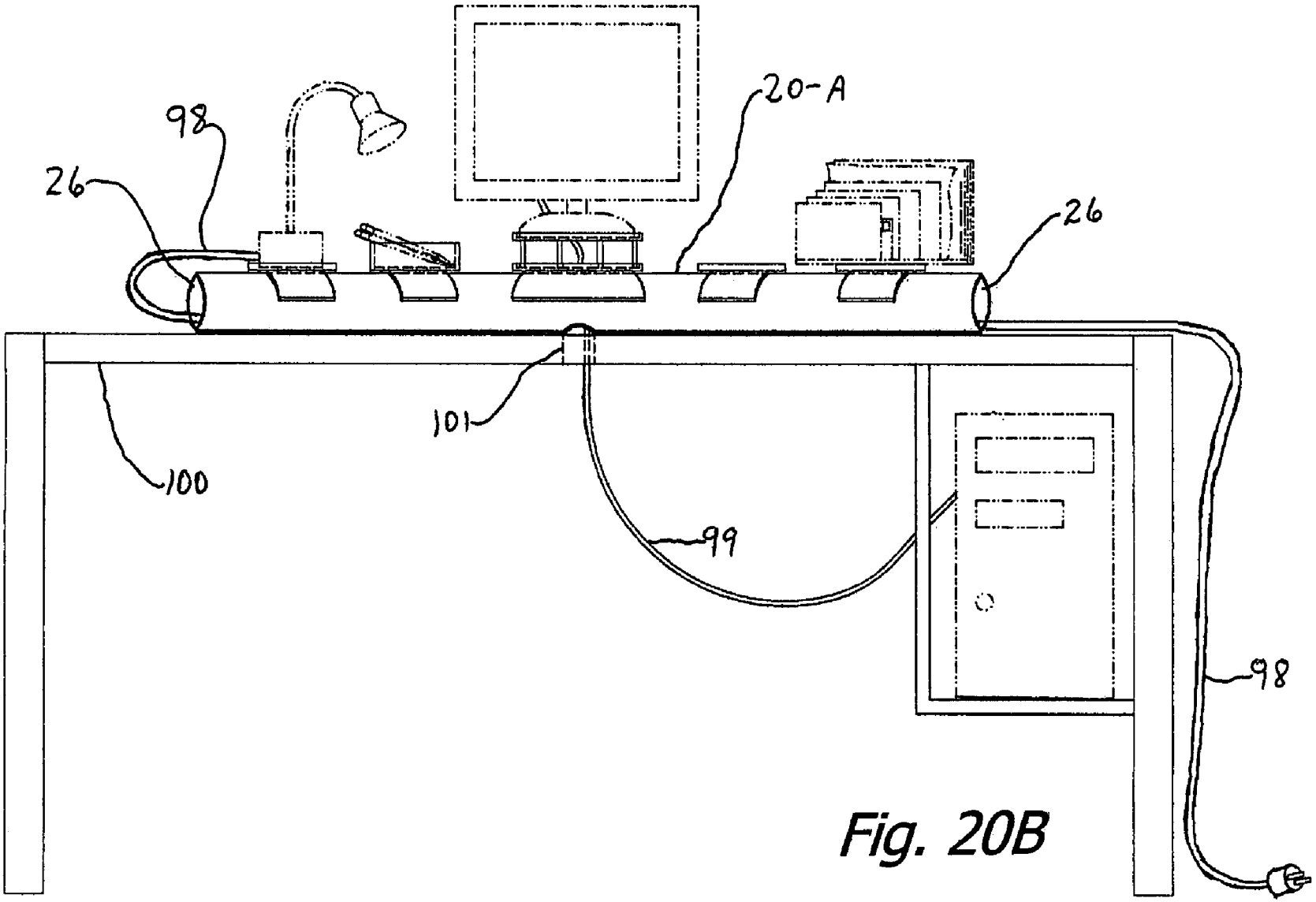
FIG. 20B is an illustration of an alternative wire routing method.

In a particular embodiment as shown in FIG. 20B the open ends 26 can permit a wire passage means that is in some cases very useful. For example, if an auxiliary device such as a lamp is organized leftwardly on the apparatus, the electrical wire of such lamp can be routed into the left open end, and the wire can exit from the right open end. This can be helpful if, for example, an electrical wall outlet is located to the right of the users station or organizing area, yet the user prefers such lamp to be organized leftwardly. In some situations, an open end 26 may be closer to a desired wire diverging location than a via-passage 24 would be. Thus, the open ends 26 can be useful in wire divergence and wire routing.

The means to attach the apparatus to a chair in one of its embodiments was partly chosen to join to the base thereof rather than to, for example, an armrest, the underside of the seat, chair back, or spindle, because by a twist of the rotating mechanism of the chair, the apparatus can be ready for mobile or more convenient station use from a ready mobile or convenient organizer arrangement. And when a user is finished with a task for example, using such mobile or more convenient station in use with a chair, the user can turn the back of the chair to position the seat to a more open and accessible manner. Of course, in the illustrated embodiment in which the plane-attachment 110 is used in conjunction with a chair, the plane-attachment 110 will have to be engaged if using such plane-attachment 110 for station use with a chair, and disengaged if positioning the apparatus behind the chair back to position the seat to a more open and accessible fashion. Or, the user can lift the apparatus from the mounting collar 124 of the chair attachment mechanism 120 and engage such apparatus to a stand-base 80 when such apparatus is not in use with a chair. However, lifting the apparatus from the mounting collar 124 is only practically possible if the vertical support 60 is not joined to the chair attachment mechanism 120 in a permanent manner.

In a particular embodiment, the plane-attachment 110 provides a generally horizontal surface for activities such as writing, typing, drawing and other desk-like uses. Alternatively, the plane-attachment 110 can also be used as another organizing means. For example, it can be used as a single bookshelf, or portable electronic devices, desk items, auxiliary items, or decorations can be placed on such as used in more of a table-like manner. If a notebook computer is used with the plane-attachment 110, the keyboard of such notebook computer is supported on the plane-structure 111, and the back of the monitor of such notebook computer can be supported or barricaded by the elongated support 20 and/or upper portion of the vertical support 60 if the notebook computer is in an open position. Thus, helping to prevent such notebook computer from being accidentally knocked off of such plane-structure 111 which can often happen from a pushing motion by the user. Other kinds of computer keyboards or the like keyboards can also be used with the plane-attachment 110 and will be barricaded in generally the same manner to help prevent such from being accidentally knocked off of such plane structure 111.

Figure 7:
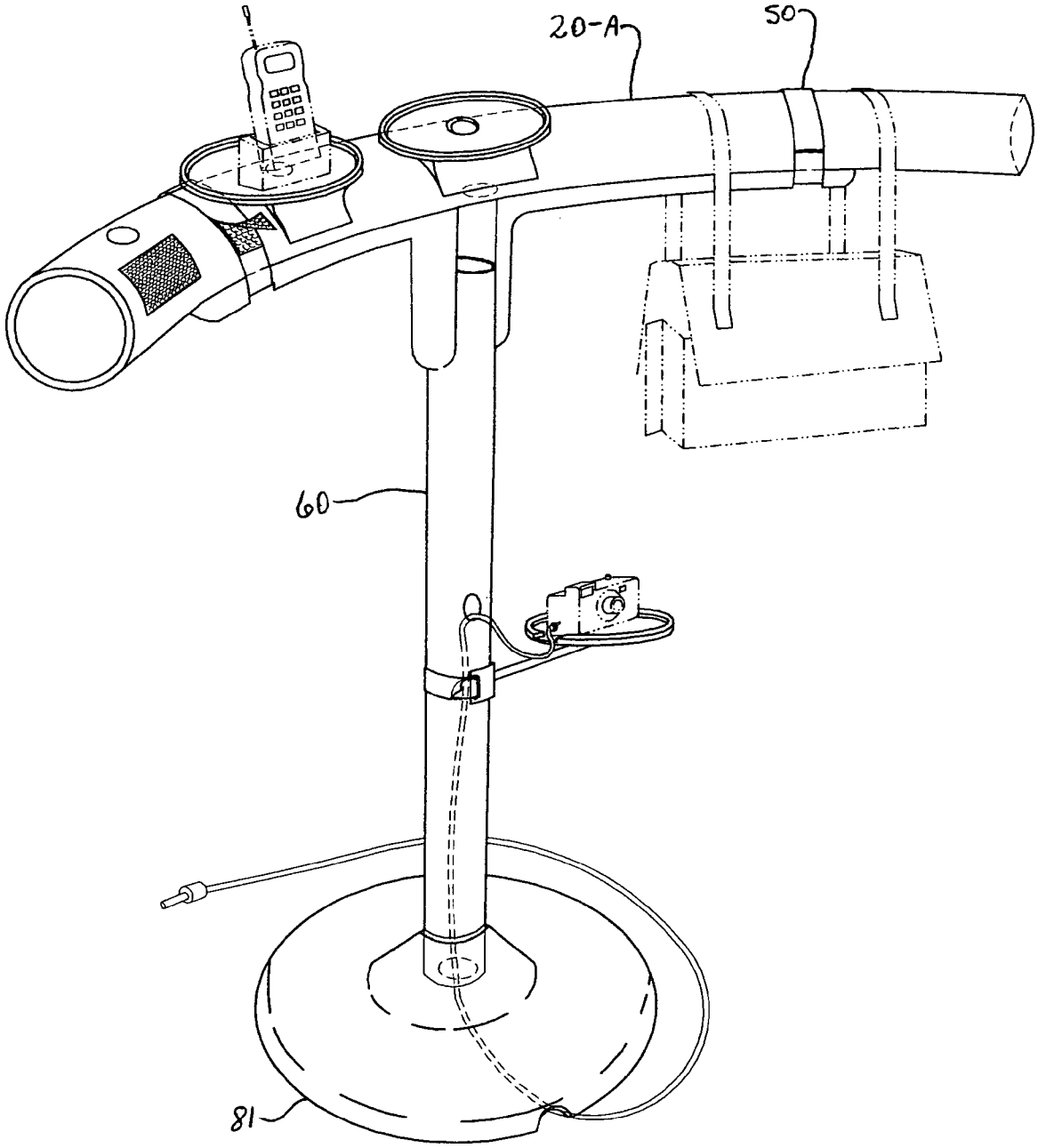
FIG. 7 is a perspective view of one of the preferred embodiments defining various holding methods.

In the illustrated embodiment as shown in FIG. 7, if the apparatus is in a high enough lifted manner such as the illustrated freestanding mode, items such as portable files, purses, or satchels can be hung by their straps from the elongated support 20. This is particularly helpful with portable files, as it can position file folders in a more accessible manner for the user.

If the apparatus is in a freestanding arrangement, it not only can be positioned completely independently, but can be positioned near a station for a kind of convenience. Such positioning can include beside, behind, and even in front of such station. For example, if a desk has a considerably longer horizontal width compared to other conventional desks, it can be practical to position the apparatus in front of such desk without such apparatus substantially interfering with the use of such desk.

The invention can address some retailers and suppliers shelf space and stocking problems. For example, if the apparatus is only to be used for a certain purpose by a user, such as exclusively desktop, exclusively as freestanding station, or exclusively embodied on a task chair, at least one member of the apparatus can be used in any such arrangement, which is the preferred embodiments of the elongate support 20. Another relatively common part would be the preferred embodiment of the vertical support 60. And many parts are relatively slimlined and compact comparatively to items of the furniture industry. Thus, it can ease stock ordering and shelf space congestion by providing ramification of common parts allowing users to possibly select an apparatus of organizing capabilities alone, tasking capabilities alone, or both organizing and tasking capabilities combined. This is very helpful in stock ordering because a margin of error is permitted if predicting purchases directed to organizing components, tasking components, and differing arrangements such as predicting if purchasers will purchase a freestanding arrangement, desktop arrangement, or chair conjunction arrangement. It is also therefore an advantage to a manufacturer to make ramifying parts because for example, less molds would have to be made, less dividing storage space is needed, and better rhythm is generally accomplished in an assembly or packaging line. Therefore, the invention permits many possible selling options. For example, it can be sold as mentioned above, or as a complete system, or as a system geared for a general arrangement such as a freestanding arrangement.

CONCLUSION AND SCOPE

Although the description above contains many specificities, these should not be construed as limiting the scope of the invention but merely providing illustrations of some of the presently preferred embodiments of this invention. For example, the elongate support can be of solid thickness and rather than have a built-in conduit means, the conduit means can be external such as having a tacked-on or integral external chase thereof. Furthermore, the conduit means is not necessary is some embodiments. For example, if the embodiment is used as a tasking station such as illustrated possible in FIGS. 4 and 5, a wire management means is preferred but not necessary for the basic functionality thereof. And in an embodiment of a chair attached organizer, the conduit means is not necessary, but is still preferred for reasons such as in case a user needs or desires conversion into a tasking station. Another example of the varying scope of the invention is that the stand-base can be on a tram and wheeled for mobility. However, since other mobility methods were disclosed by way of the capability of the apparatus being easily assembled and disassembled and by the wheeled mobility of a task chair or the like, the stand-base is depicted as more of a stable support structure.

It should also be noted that the rearrangement of parts or systematic progression of a similar embodiment is within the scope of this invention. For example, the illustrations from FIG. 1 to 8 may represent a systematic progression of the invention from a desktop organizer evolving to have a free-standing accessory means, then a chair attachment accessory, and continued progression. However, it could be represented as a vertical support with holder attachments, then progressing to have an attachable horizontal support or chair attachment mechanism and possibly progress from that point. Furthermore, the invention in its preferred embodiment is accommodating to possible future designed accessories by providing various means and methods of attaching such, and provides at least one predetermined implement that can be used in utility concept methods.

While the invention has been described with reference to at least one preferred embodiment, it is not intended to limit the scope of the invention to the particular form(s) set forth, but on the contrary, it is intended to cover such alternatives, modifications, and equivalents as may be included within the spirit and scope of the invention as defined by the appended claims.

What is claimed is:

1. An organizer kit comprising:

an arcuate circular-tube support member having an upper side and a lower side, a plurality of upper apertures in said upper side with each of said upper apertures being disposed at a different upper location, and at least one lower aperture at a central location in said lower side, said arcuate, circular-tube support member accommodating at least one wire, said at least one wire comprising a first portion that is routable, hidden from view and protected within said arcuate, tubular support member, a second portion that is routable through one of said upper apertures and a third portion that is routable through said at least one lower aperture;

a plurality of mounts, each of said mounts conforming to and being attachable to said arcuate, tubular support member at one of said different upper locations;

a plurality of holders, each of said holders being fixed to one of said mounts;

a vertical, tubular support member that is releasably connectable to said arcuate, tubular support member at a right angle and at said central location and that is adapted to receive said third portion; and a chair attachment mechanism comprising a saddle for overlying and engaging an outwardly extending leg member of a chair, an outwardly extending extension neck that is attached to said saddle and a mounting collar that is attached to said extension neck, that is upwardly open, and that accepts said vertical, tubular support member;

wherein said arcuate circular-tube support member is usable on a desktop and is usable with said vertical support member attached to said chair by means of said chair attachment mechanism;

thereby facilitating the accommodation of at least one electronic device on one of said holders.

2. The organizer kit of claim 1 further comprising:

a stand-base that is connectable to said vertical, tubular support member.

3. The organizer kit of claim 2 wherein said vertical, tubular support member is provided with a hole and said organizer kit further comprises:

a holder-attachment accessory that is attachable to said vertical, tubular support member adjacent to said hole by means of a rod, a yoke-like plate and a mounting strap.

4. The organizer kit of claim 1 wherein said lower side is flat.

5. The organizer kit of claim 1 wherein each of said mounts is releasably attachable to said arcuate, tubular support member by means of a hook and loop fastener.

6. The organizer kit of claim 1 wherein each of said holders is selected from the group consisting of: a bowl-like holder comprising a disc-plane with an annular flange, a plate-like holder and an auxiliary-stand comprising a base and at least one stanchion.

7. The organizer kit of claim 1 further comprising:

a plane-attachment that is attachable to said arcuate, tubular support member by means of a pair of hook rods.

8. The organizer kit of claim 1 wherein said arcuate circular-tube support member has open ends.

9. An organizer for attachment to a chair having a plurality of legs, said organizer comprising:

an arcuate, tubular support member having an upper side and a lower side, said support member having a plurality of upper apertures in said upper side with each of said upper apertures being disposed at a different upper location, and at least one lower aperture at a central location in said lower side;

wherein said arcuate, tubular support member accommodates at least one wire, said at least one wire comprising a first portion that is routable, hidden from view and protected within said arcuate circular support member, a second portion that is routable through one of said upper apertures and a third portion that is routable through said at least one lower aperture;

a plurality of mounts, each of said mounts being attachable to said arcuate, tubular support member at one of said different upper locations;

a plurality of holders, each of said holders being fixed to one of said mounts;

a vertical, tubular support member that is releasably connectable to said arcuate, tubular support member at a right angle and at said central location and that is adapted to receive said third portion; and a chair attachment mechanism that is adapted to be fastened to one or more of the plurality of legs and to support said vertical, tubular support member, said chair attachment mechanism comprising a saddle for overlying and engaging an outwardly extending leg member of a chair, an outwardly extending extension neck that is attached to said saddle and a mounting collar that is attached to said extension neck, that has an upwardly open end and that accepts said vertical, tubular support member within said upwardly open end;

whereby said arcuate, tubular support member is usable on a desktop and is usable with said vertical, tubular support member attached to said chair with said chair attachment mechanism.

10. The organizer kit of claim 9 further comprising:

a counterweight that is attached to one or more opposing legs of the plurality of legs of the chair.

11. An organizer comprising:

a support member selected from the group consisting of:

an arcuate, cylindrical-tube support member comprising an upper side and a lower side and having a plurality of upper apertures in said upper side with each of said upper apertures being disposed at a different upper location, and at least one lower aperture in said lower side, said arcuate, cylindrical-tube support member having a substantially circular cross section;

a channeled-block support member comprising two upper lip-tracks that define an upper aperture and a substantially planar lower side and having an elongate cavity or channel and at least one lower aperture in said substantially planar lower side, said two upper lip-tracks providing a plurality of different upper locations; and a squared-tube support member comprising an upper side and a lower side and having a plurality of upper apertures in said upper side with each of said upper apertures being disposed at a different upper location, and at least one lower aperture in said lower side, said squared-tube support member having a substantially square cross section;

wherein said support member accommodates at least one wire, said at least one wire comprising a portion that is routable, hidden from view and protected within said support member, a second portion that is routable through one of said upper apertures and a third portion that is routable through said at least one lower aperture;

a plurality of mounts, each of said mounts being attached to said support member at one of said upper locations;

a plurality of holders, each of said holders being fixed to one of said mounts;

a vertical support member that is releasably connectable to said support member at a right angle and at said central location and that is adapted to receive said third portion; and a chair attachment mechanism that is adapted to be attached to a chair leg with a fastener and to support said vertical support member, said chair attachment mechanism comprising a saddle for overlying and engaging an outwardly extending leg member of a chair, an outwardly extending extension neck that is attached to said saddle and a mounting collar that is attached to said extension neck, that has an upwardly open end and that accepts said vertical, tubular support member within said upwardly open end;

wherein said support member is usable on a desktop and is usable with said vertical support member attached to said chair by means of said chair attachment mechanism;

thereby facilitating the accommodation of at least one electronic device on one of said holders.

12. The organizer of claim 11 further comprising:

a stand-base that is connectable to said support member.

13. The organizer of claim 12 wherein said support member is provided with a hole and said organizer further comprises:

a holder-attachment accessory that is attachable to said support member adjacent to said hole by means of a rod, a yoke-like plate and a mounting strap.

14. The organizer of claim 11 wherein each of said mounts is releasably attachable to said support member by means of a hook and loop fastener.

15. The organizer of claim 11 wherein each of said holders is selected from the group consisting of: a bowl-like holder comprising a disc-plane with an annular flange, a plate-like holder and an auxiliary-stand comprising a base and at least one stanchion.

16. The organizer of claim 11 further comprising:

a plane-attachment that is attachable to said support member by means of a pair of hook rods.

17. The organizer of claim 11 wherein said support member has open ends.

18. The organizer of claim 11 wherein said support member is tubular.

* * * * *